US006844124B2

(12) United States Patent
Ikuno et al.

(10) Patent No.: US 6,844,124 B2
(45) Date of Patent: Jan. 18, 2005

(54) ELECTROPHOTOGRAPHIC PHOTORECEPTOR, METHOD FOR MANUFACTURING THE PHOTORECEPTOR, AND IMAGE FORMING METHOD AND APPARATUS USING THE PHOTORECEPTOR

(75) Inventors: Hiroshi Ikuno, Yokohama (JP); Hidetoshi Kami, Numazu (JP); Ryohichi Kitajima, Numazu (JP); Narihito Kojima, Numazu (JP); Akihiko Matsuyama, Isehara (JP); Hiroshi Nagame, Numazu (JP); Katsuichi Ohta, Mishima (JP); Tetsuro Suzuki, Fuji (JP); Nozomu Tamoto, Numazu (JP); Hiroshi Tamura, Susono (JP); Yohta Sakon, Numazu (JP); Eiji Kurimoto, Numazu (JP); Tatsuya Niimi, Numazu (JP); Yuka Miyamoto, Numazu (JP)

(73) Assignee: Ricoh Company Limited, Tokyo (JP)

( * ) Notice: Subject to any disclaimer, the term of this patent is extended or adjusted under 35 U.S.C. 154(b) by 25 days.

(21) Appl. No.: 10/638,637

(22) Filed: Aug. 12, 2003

(65) Prior Publication Data

US 2004/0048178 A1 Mar. 11, 2004

Related U.S. Application Data

(62) Division of application No. 09/985,348, filed on Nov. 2, 2001, now Pat. No. 6,641,964.

(30) Foreign Application Priority Data

| | | |
|---|---|---|
| Nov. 2, 2000 | (JP) | 2000-336588 |
| Mar. 14, 2001 | (JP) | 2001-072992 |
| Sep. 28, 2001 | (JP) | 2001-302660 |

(51) Int. Cl.[7] ..... G03G 15/02

(52) U.S. Cl. ..... 430/58.7; 252/364; 524/543

(58) Field of Search ..... 430/58.7; 252/364; 524/543

(56) References Cited

U.S. PATENT DOCUMENTS

| | | | |
|---|---|---|---|
| 4,647,521 | A | 3/1987 | Oguchi et al. |
| 5,028,502 | A | 7/1991 | Yuh et al. |

(List continued on next page.)

FOREIGN PATENT DOCUMENTS

| | | |
|---|---|---|
| JP | 1-205171 | 8/1989 |
| JP | 6-89036 | 3/1994 |
| JP | 6-308757 | 11/1994 |
| JP | 7-333881 | 12/1995 |
| JP | 8-15887 | 1/1996 |
| JP | 8-124053 | 5/1996 |
| JP | 8-146641 | 6/1996 |
| JP | 8-292585 | 11/1996 |

OTHER PUBLICATIONS

Derwent Abstracts, AN 1975–71237W, JP 49–128733, Dec. 10, 1974.
Patent Abstracts of Japan, JP 63–170647, Jul. 14, 1988.
Derwent Abstracts, AN 1994–141433, JP 60–89036, Mar. 29, 1994.

*Primary Examiner*—Mark A. Chapman
(74) *Attorney, Agent, or Firm*—Oblon, Spivak, McClelland, Maier & Neustadt, P.C.

(57) ABSTRACT

An electrophotographic photoreceptor including an electroconductive substrate; a photosensitive layer located overlying the electroconductive substrate and including a resin; and a surface layer including a filler and a binder resin, wherein the surface layer and the photosensitive layer have a continuous structure, and wherein the surface layer satisfies the following relationship: $\sigma \leqq D/5$, wherein D represents an average of maximum thicknesses of the surface layer in units of micrometers in 20 segments of 5 $\mu$m wide when a portion of a cross section of the photoreceptor of 100 $\mu$m wide is divided into the 20 segments, and $\sigma$ represents a standard deviation of the 20 maximum thicknesses.

9 Claims, 8 Drawing Sheets

U.S. PATENT DOCUMENTS 5,100,453 A 3/1992 Richards
5,204,202 A 4/1993 Ishikawa et al.
5,547,790 A 8/1996 Umeda et al.
5,677,094 A 10/1997 Umeda et al.
5,693,442 A 12/1997 Weiss et al.
5,707,767 A 1/1998 Yu
5,723,243 A 3/1998 Sasaki et al.
5,747,204 A 5/1998 Anzai et al.
5,789,128 A 8/1998 Adachi et al.
5,798,200 A 8/1998 Matsuura et al.
5,804,343 A 9/1998 Umedat et al.
5,834,145 A 11/1998 Yoshinaga et al.
5,840,454 A 11/1998 Nagai et al.
5,846,680 A 12/1998 Adachi et al.
5,853,935 A 12/1998 Suzuki et al.
5,871,876 A 2/1999 Ikuno et al.
5,910,561 A 6/1999 Adachi et al.
5,928,828 A 7/1999 Suzuki
5,942,363 A 8/1999 Tanaka et al.
5,976,746 A 11/1999 Tamaka et al.
5,999,773 A 12/1999 Yasutomi et al.
6,026,262 A 2/2000 Kinoshita et al.
6,027,846 A 2/2000 Shimada et al.
6,030,733 A 2/2000 Kami et al.
6,030,736 A 2/2000 Ikegami et al.
6,045,959 A 4/2000 Katayama et al.
6,066,428 A 5/2000 Katayama et al.
6,069,224 A 5/2000 Adachi et al.
6,087,055 A 7/2000 Niimi
6,093,784 A 7/2000 Tamura et al.
6,132,911 A 10/2000 Niimi
6,136,483 A 10/2000 Suzuki et al.
6,187,494 B1 2/2001 Kawamura et al.
6,191,249 B1 2/2001 Tanaka et al.
6,210,848 B1 4/2001 Nagai et al.
6,218,533 B1 4/2001 Niimi
6,249,304 B1 6/2001 Sawayama et al.
6,300,027 B1 10/2001 Chambers et al.
6,322,940 B1 11/2001 Nishigaki et al.
6,326,112 B1 12/2001 Tamura et al.
6,366,751 B1 4/2002 Shakuto et al.
6,406,826 B1 6/2002 Suzuki et al.
6,432,596 B2 8/2002 Ikuno et al.
6,444,387 B2 9/2002 Ri et al.
6,468,706 B2 10/2002 Matsuda et al.
6,492,081 B2 12/2002 Morikawa et al.
6,548,216 B2 * 4/2003 Kawamura et al. ..... 430/59.6

* cited by examiner

ELECTROPHOTOGRAPHIC PHOTORECEPTOR, METHOD FOR MANUFACTURING THE PHOTORECEPTOR, AND IMAGE FORMING METHOD AND APPARATUS USING THE PHOTORECEPTOR

This application is a Division of application Ser. No. 09/985,348, filed on Nov. 2, 2001, which issued as U.S. Pat. No. 6,641,964, on Nov. 4, 2003.

BACKGROUND OF THE INVENTION

1. Field of the Invention

The present invention relates to an electrophotographic photoreceptor. In addition, the present invention relates to a method for manufacturing the photoreceptor, and an image forming method and apparatus using the photoreceptor.

2. Discussion of the Background

Electrophotography is one of image forming methods and typically includes the following processes:

(1) charging a photoreceptor in a dark place (charging process);

(2) irradiating the charged photoreceptor with imagewise light to selectively decay the charge on a lighted area of the photoreceptor, resulting in formation of an electrostatic latent image thereon (light irradiating process);

(3) developing the electrostatic latent image with a developer including a toner mainly constituted of a colorant and a binder to form a toner image on the photoreceptor (developing process);

(4) optionally transferring the toner image on an intermediate transfer medium (first transfer process);

(5) transferring the toner image onto a receiving material such as a receiving paper ((second) transfer process);

(6) heating the toner image to fix the toner image on the receiving material (fixing process); and (7) cleaning the surface of the photoreceptor (cleaning process).

In such image forming methods, requisites (i.e., electrophotographic properties requisite) for the photoreceptors are as follows:

(1) to be able to be charged so as to have a proper potential in a dark place;

(2) to have a high charge retainability (i.e., to keep the charge well-in a dark place); and (3) to rapidly decay the charge thereon upon application of light thereto (i.e., the potential of a lighted-area is low).

Until now, photoreceptors in which one of the following photosensitive layers is formed on an electroconductive substrate have been used:

(1) layers mainly including selenium or a selenium alloy;

(2) layers in which an inorganic photoconductive material such as zinc oxide or cadmium sulfide is dispersed in a binder resin;

(3) layers using an organic photoconductive material such as azo pigments and combinations of poly-N-vinylcarbazole and trinitrofluorenone; and (4) layers using amorphous silicon.

Currently, organic photoreceptors using an organic photosensitive materials are widely used because of satisfying such requisites as mentioned above and having the following advantages over the other photoreceptors:

(1) manufacturing costs are relatively low;

(2) having good designing flexibility (i.e., it is easy to design a photoreceptor having a desired property); and (3) hardly causing environmental pollution.

As for the organic photoreceptors, the following photosensitive layers are known:

(1) a photosensitive layer including a photoconductive resin such as polyvinyl carbazole (PVK) or the like material;

(2) a charge transfer photosensitive layer including a charge transfer complex such as a combination of polyvinyl carbazole (PVK) and 2,4,7-trinitrofluorenone (TNF) or the like material;

(3) a photosensitive layer in which a pigment, such as phthalocyanine or the like, is dispersed in a binder resin; and (4) a functionally-separated photosensitive layer including a charge generation material (hereinafter a CGM) and a charge transport material (hereinafter a CTM).

Among these organic photoreceptors, the photoreceptors having a functionally-separated photosensitive layer especially attract attention now.

The mechanism of forming an electrostatic latent image in the functionally-separated photosensitive layer having a charge generation layer (hereinafter a CGL) and a charge transport layer (hereinafter a CTL) formed on the CGL is as follows:

(1) when the photosensitive layer is exposed to light after being charged, light passes through the light-transmissive CTL and then reaches the CGL;

(2) the CGM included in the CGL absorbs the light and generates a charge carrier such as an electron and a positive hole;

(3) the charge carrier is injected to the CTL and transported through the CTL due to the electric field formed by the charge on the photosensitive layer;

(4) the charge carrier finally reaches the surface of the photosensitive layer and neutralizes the charge thereon, resulting in formation of an electrostatic latent image.

For such functionally-separated photoreceptors, a combination of a CTM mainly absorbing ultraviolet light and a CGM mainly absorbing visible light is effective and is typically used. Thus, functionally-separated photoreceptors satisfying the requisites as mentioned above can be prepared.

Currently, needs such as high speed recording and downsizing are growing for electrophotographic image forming apparatus. Therefore, an increasing need exists for durable photoreceptors having high reliability, which can produce good images even when repeatedly used for a long period of time while having the above-mentioned requisites.

Photoreceptors used for electrophotography receive various mechanical and chemical stresses. When a photoreceptor is abraded due to these stresses and its photosensitive layer is thinned, undesired images are produced.

In attempting to solve this abrasion problem, a technique in which a filler is included in a photoreceptor, and a technique in which a filler is dispersed in a surface of a photosensitive layer have been disclosed in Japanese Laid-Open Patent Publications Nos. (hereinafter JOPs) 1-205171, 7-333881, 8-15887, 8-123053 and 8-146641.

The photoreceptors having a surface layer including a filler dispersed in a binder resin tend to cause the following problems:

(1) Peeling of Surface Layer

When a photosensitive layer and a surface layer formed thereon have a discontinuous structure, the surface layer tends to be peeled from the photosensitive layer when the photoreceptor is repeatedly used for a long period of time.

(2) Increase of Lighted-Area Potential

When a photosensitive layer and a surface layer have a discontinuous structure, the potential of a lighted-area of the photoreceptor increases when the photoreceptor is repeatedly used for a long period of time.

(3) Poor Fine Dot Reproducibility

When a photosensitive layer and a surface layer have a discontinuous structure (i.e., the surface of the photosensitive layer is not dissolved by the surface layer coating liquid coated on the photosensitive layer), the image qualities of initial images produced by the photoreceptor are good. However, when the photoreceptor is repeatedly used, the problems mentioned in items (1) and (2) tend to occur. To the contrary, when the photosensitive layer and the surface layer have a continuous structure (i.e., the photosensitive layer is dissolved by the surface layer coating liquid coated on the photosensitive layer), the image qualities tend to deteriorate depending on the degree of dissolution of the photosensitive layer.

(4) Uneven Abrasion

When a photosensitive layer and a surface layer have a continuous structure and in addition the photosensitive layer is largely dissolved by the surface layer coating liquid including a filler and coated on the photosensitive layer, the filler is seriously unevenly dispersed at the interfacial portion between the photosensitive layer and the surface layer. When such a photoreceptor is repeatedly used for a long period of time, the photoreceptor is abraded unevenly, resulting in deterioration of image qualities.

(5) Edge Effect of Solid Image

When the surface of a photoreceptor is charged so as to have a solid latent image having a very even potential and the solid latent image is developed with a toner, the edge portion of the resultant solid toner image has a larger amount of toner particles than the other portions (this phenomenon is referred to as a so-called "edge effect") because the electric fluxlines at the edge portion erect. Therefore, fat images and toner-scattered images are produced.

In attempting to this problem, a method in which fine uneven potentials are formed on the surface of the photoreceptor is used. By this method, the edge effect can be avoided, and therefore, the chance that fat images and toner-scattered images are produced can be decreased.

On the other hand, as the methods for forming a surface layer, spray coating methods, ring coating methods, dip coating methods, etc. are typically used.

At first, the spray coating methods will be explained.

JOP 6-308757 discloses a spray coating method using a coating liquid including a solvent not dissolving the photosensitive layer on which the coating liquid is to be coated. When coating this coating liquid using a spray coating method, the surface layer does not dissolve the photosensitive layer, namely, the photosensitive layer and a surface layer have a discontinuous structure. It is described in JOP 6-308757 that the photosensitive layer having such a structure produces images having good image qualities because the surface layer coating liquid does not dissolve the photosensitive layer.

When this photoreceptor is prepared by the present inventors according to the method described in the publication, the photosensitive layer and a surface layer have a discontinuous structure. When image qualities of such a photoreceptor are evaluated, initial images have good image qualities but the surface layer peels from the photosensitive layer at the edge portion of the photoreceptor when the photoreceptor is repeatedly used. This is because the surface layer has poor adhesion with the photosensitive layer. In addition, when the photoreceptor is repeatedly used, the lighted-area potential increases and thereby image qualities deteriorate. This is because the charge injection from the lower layer (photosensitive layer) to the upper layer (surface layer) is obstructed due to the discontinuous structure of the surface layer and the photosensitive layer. In addition, it is possible that by using a surface layer coating liquid including a solvent not dissolving the photosensitive layer, the charge transport material in the photosensitive layer tends to crystallizes, and thereby undesired images are produced.

JOP 6-89036 discloses a spray coating method using a coating liquid including a solvent dissolving the photosensitive layer on which the coating liquid is to be coated. When such a coating liquid is coated using a spray coating method, the solvent dissolves the binder resin in the photosensitive layer, and thereby the surface layer is mixed with the photosensitive layer at their interface. Therefore, the photosensitive layer and the surface layer have a continuous structure. When such a photoreceptor is repeatedly used, such a peeling problem as mentioned above does not occur because the surface layer has good adhesion with the photosensitive layer. However, since the mixing conditions of the layers are not specified, other properties (such as image qualities) of the photoreceptor are not necessarily good because the properties largely change depending on the mixing conditions.

Then the ring coating methods will be explained.

JOP 8-292585 discloses a method in which a surface layer is formed by coating a coating liquid including a solvent dissolving the photosensitive layer using a ring coating method. When such a coating liquid is coated using a ring coating method, the solvent dissolves the binder resin in the photosensitive layer, and thereby the surface layer is mixed with the photosensitive layer at their interface. Namely, the photosensitive layer and the surface layer have a continuous structure. When such a photoreceptor is repeatedly used to evaluate the image qualities, such a peeling problem as mentioned above does not occur and in addition the lighted-area potential hardly increases. However, the image qualities are not good. This is because the conditions of the surface layer and the coating conditions are such that the resin and other components included in the photosensitive layer are excessively dissolved into the surface layer.

JOP 5-722749 discloses an image bearing member in which a surface layer coating liquid including an electroconductive particulate material and a solvent dissolving the lower layer (i.e., heat-softening layer) on which the coating liquid is to be coated is coated on the lower layer. However, there are no descriptions with respect to the coating conditions, and in addition the mixing conditions of the surface layer and the lower layer are not described. Therefore it is unknown whether the properties of the resultant image bearing member are good.

Because of these reasons, a need exists for a photoreceptor which has good mechanical durability and stable electrophotographic properties such that images having good image qualities can be stably produced even when the photoreceptor is repeatedly used for a long period of time.

SUMMARY OF THE INVENTION

Accordingly, an object of the present invention is to provide an electrophotographic photoreceptor which has good mechanical durability and stable electrophotographic properties such that images having good image qualities can be stably produced even when the photoreceptor is repeatedly used for a long period of time.

Another object of the present invention is to provide a method for preparing the photoreceptor mentioned above.

Yet another object of the present invention is to provide a surface layer coating liquid for the photoreceptor mentioned above.

A further object of the present invention is to provide an image forming method and apparatus by which images having good image qualities can be stably produced for a long period of time without frequently changing the photoreceptor.

Briefly these objects and other objects of the present invention as hereinafter will become more readily apparent can be attained by an electrophotographic photoreceptor including an electroconductive substrate, a photosensitive layer located overlying the electroconductive substrate and a surface layer located on the photosensitive layer and including a filler and a binder resin, wherein the surface layer and the photosensitive layer have a continuous structure (i.e., the layers do not have a clear interface except that the surface layer includes a filler and the photosensitive layer does not include a filler), and wherein the surface layer satisfies the following relationship:

$$\sigma \leqq D/5$$

wherein D represents an average of maximum thicknesses of the surface layer in units of micrometers in 20 segments of 5 $\mu$m wide of the photoreceptor when a portion of 100 $\mu$m wide of the cross section of the photoreceptor is divided into the 20 segments, and a represents a standard deviation of the 20 maximum thicknesses.

"Overlying" can include direct contact and allow for intermediate layers.

The standard deviation is defined by the following popular formula:

$$\sigma = \left\{ \sum_{i=1}^{n} (Xi - D)^2 / (n-1) \right\}^{1/2}$$

wherein Xi represents each of the maximum thicknesses, D represents the average of the maximum thicknesses. In this case n is 20.

The standard deviation $\sigma$ of the maximum thickness is preferably not greater than D/7. The average maximum thickness D of the surface layer is preferably from 1.0 $\mu$m to 8.0 $\mu$m.

The photosensitive layer is preferably a layered photosensitive layer including a CGL and a CTL.

The filler in the surface layer preferably is an inorganic filler such as metal oxides. More preferably the inorganic filler is a material selected from the group consisting of silica, titanium oxide and aluminum oxide.

The surface layer preferably includes a CTM, and more preferably a charge transport polymer. The charge transport polymer is preferably a polymer selected from the group consisting of polycarbonates, polyurethanes, polyesters and polyethers. The charge transport polymer is preferably a polycarbonate having a triarylamine group.

In another aspect of the present invention, a method for preparing a photoreceptor including the steps of forming a photosensitive layer including a resin on an electroconductive substrate; providing a surface layer coating liquid including a resin, a filler and a solvent which can dissolve the photosensitive layer; and coating the surface layer coating liquid on the photosensitive layer using a spray coating method, wherein the method satisfies the following relationship:

$$1.2 < A/B < 2.0$$

wherein A represents a weight of a film of the surface layer per a unit area, which is prepared by coating the surface layer coating liquid directly on the surface of the electroconductive substrate by the spray coating method and then drying at room temperature for 60 minutes and B represents a weight of the film per the unit area, which is prepared by perfectly drying the film such that the content of the solvent remaining in the film is not greater than 1000 ppm.

The solvent in the surface layer coating liquid preferably includes a first organic solvent having a boiling point of from 50° C. to 80° C. such as tetrahydrofuran and dioxolan and a second organic solvent having a boiling point of from 130° C. to 160° C. such as cyclohexanone, cyclopentanone and anisole.

The surface layer coating liquid preferably has a solid content of from 3.0 to 6.0% by weight.

The coated surface layer coating liquid is preferably dried at a temperature of from 130° C. to 160° C. for a time of from 10 to 60 minutes.

In yet another aspect of the present invention, an image forming apparatus is provided which includes the photoreceptor of the present invention; a charger configured to charge the photoreceptor; an image irradiator configured to irradiate the photoreceptor with imagewise light to form an electrostatic latent image on the surface of the photoreceptor; an image developer configured to develop the latent image with a toner to form a toner image on the photoreceptor; and an image transferer configured to transfer the toner image on a receiving material optionally via an intermediate transfer medium.

The image irradiator preferably includes a laser diode (LD) or a light emitting diode (LED) as a light source.

The charger is preferably a proximity charger which charges the photoreceptor while closely to but not touching the surface of the photoreceptor. In addition, the charger preferably applies a DC voltage overlapped with an AC voltage to the photoreceptor.

In a further aspect of the present invention, a process cartridge is provided which includes at least the photoreceptor of the present invention, and a housing containing the photoreceptor.

In a still further aspect of the present invention, an image forming method is provided which includes the steps of charging the photoreceptor of the present invention; irradiating the photoreceptor with imagewise light to form an electrostatic latent image on the photoreceptor; developing the latent image with a toner to form a toner image on the photoreceptor; and transferring the toner image on a receiving material optionally via an intermediate transfer medium.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

The electrophotographic photoreceptor of the present invention includes an electroconductive substrate, a photosensitive layer located on the electroconductive substrate, and a surface layer located on the photosensitive layer and including a filler and a binder resin, wherein the surface layer and the photosensitive layer have a continuous structure, and wherein the surface layer satisfies the following relationship:

$$\sigma \leqq D/5$$

wherein D represents an average of maximum thicknesses of the surface layer in units of micrometers in 20 segments when a portion of 100 μm wide of the cross-section of the photoreceptor is divided into the 20 segments, and σ represents a standard deviation of the maximum thicknesses.

The image forming apparatus of the present invention using such a photoreceptor has good mechanical durability and electrophotographic properties and can produce images having good image qualities.

At first, the structure of the photosensitive layer and surface layer will be explained.

Figure 1A:
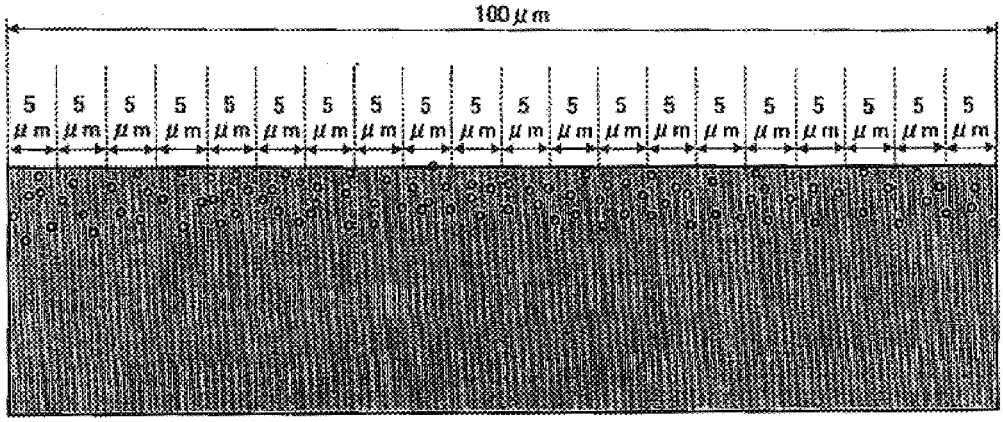
FIG. 1A is a schematic cross-sectional view illustrating the photoreceptor of the present invention for explaining how to determine the average maximum thickness D of the surface layer.
Figure 1B:
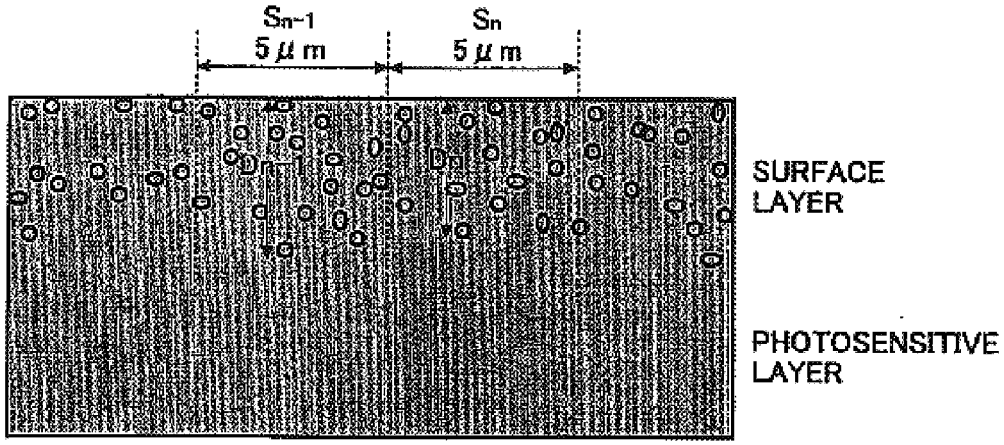
FIG. 1B is a schematic cross section of the surface layer of the photoreceptor of the present invention in which a surface layer and a photosensitive layer have a continuous structure and for explaining how to determine the maximum thicknesses Dn of the surface layer and its standard deviation σ.

The continuous structure in which the photosensitive layer and the surface layer should have in the present invention means such structures as shown in FIGS. 1A and 1B. Namely, in the photoreceptor of the present invention the photosensitive layer and the surface layer do not have a clear boundary (interface) except that the surface layer includes a filler and the photosensitive layer does not include a filler. In other words, the constituents of the photosensitive layer, such as a resin and a photosensitive material (in particular a resin), and the resin in the surface layer do not have a clear boundary (interface).

In order to form such a continuous structure, both the resin included in the surface layer and at least one of the constituents (particularly the resin) included in the photosensitive layer need to dissolve in a solvent. When a surface layer coating liquid including such a solvent is coated on a photosensitive layer, one or more of the constituents (the resin) present on the surface of the photosensitive layer are dissolved by the solvent when the coating liquid contacts the surface of the photosensitive layer. Thereby, the resin in the surface layer coating liquid mixes with the constituents present on the surface of the photosensitive layer, resulting in formation of the continuous structure.

Figure 1C:
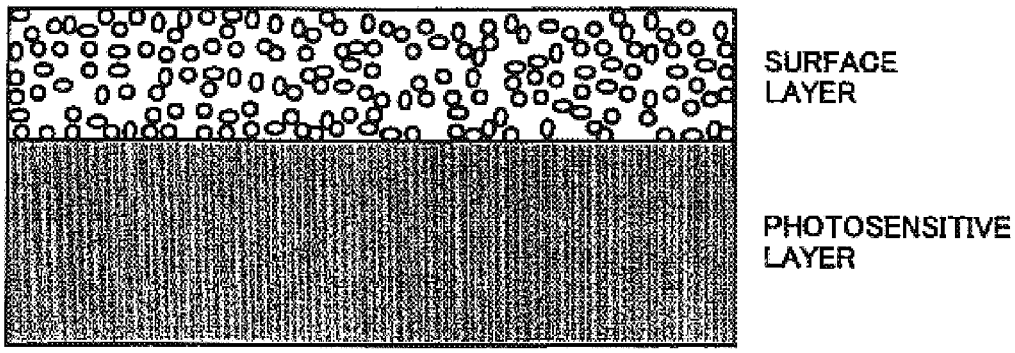
FIG. 1C is a schematic cross-sectional view of a comparative photoreceptor in which a surface layer and a photosensitive layer have a discontinuous structure.

To the contrary, the discontinuous structure of the photosensitive layer and surface layer means such a structure as shown in FIG. 1C. Namely, the photosensitive layer and the surface layer have a clear boundary. Such a discontinuous structure can be formed by coating a surface layer coating liquid including a solvent not dissolving the constituents in the photosensitive layer. When such a coating liquid is coated on the photosensitive layer, a clear boundary can be formed because the photosensitive layer (particularly the resin in the photosensitive layer) is not dissolved by the solvent.

Next, the maximum thickness Dn, the average maximum thickness D and the standard deviation σ of the maximum thickness Dn will be explained.

The maximum thickness Dn and the average maximum thickness D of the photoreceptor of the present invention can be determined by observing the cross section of the photoreceptor. The cross section of a photoreceptor can be prepared by cutting the photoreceptor in the thickness direction perpendicular to the surface of the photoreceptor using a microtome, etc. The thus prepared cross section is observed by a scanning electron microscope (SEM) of 2,000 power magnification and photographed. As shown in FIG. 1A, an area of 100 μm length of the photographed surface portion of the photoreceptor is equally divided into 20 segments (i.e., the width of each segment is 5 μm). The maximum thickness Dn of each segment is determined as the distance between the surface of the segment and the filler particle which is located at the lowest position in the segment. Namely, as can be understood from FIG. 1B, in the segments Sn-1 and Sn, the maximum thickness of the surface layer is Dn-1 and Dn, respectively. The average maximum thickness D of the surface layer is defined as the arithmetical average of the thus determined 20 maximum thicknesses. In addition, the standard deviation a is defined as the standard deviation of the 20 maximum thicknesses.

Then the reason why the average maximum thickness and the standard deviation should be determined while dividing the surface portion of 100 μm wide into 20 segments of 5 μm wide will be explained.

The average particle diameter of the toner currently used for electrophotographic image forming apparatus is from about 5 to 10 μm. As a result of an image forming experiment using such a toner, it is found that an image consisting of solid images having a width of about 100 μm and having different image densities is observed as an uneven density image.

In addition, in an image forming apparatus in which an electrostatic latent dot image is formed by switching on/off light, when the average diameter of the light beam (i.e., a half width, provided that the illuminance of the light beam accords with the Gaussian curve) is 100 μm, it is found that an image consisting of solid images having a diameter of 100 μm and having different image densities is observed as an undesired density image. In addition, when the light beam has an average diameter less than 100 μm, seriously uneven density images are produced.

The present inventors discover that this variation in image density of the dot images correlates with the standard deviation a of the maximum thickness Dn. Namely, it is found that when a toner having an average particle diameter of from 5 to 10 μm is used, the correlation of the standard deviation a of the maximum thicknesses Dn in 20 segments of 5 μm width with the degree of the variation in image density of the dot images is very high. Therefore, when the conditions of the surface portion of the photoreceptor are properly controlled such that the surface layer has the above-mentioned specific maximum thickness and standard deviation, occurrence of uneven images can be prevented.

The surface portion is sampled from the image forming portion of the photoreceptor and the average maximum thickness D and standard deviation σ thereof are measured by the method mentioned above. The standard deviation σ is not greater than one fifth (1/5) of the average maximum thickness D of the surface layer, and preferably not greater than 1/7 (i.e., D/7).

The maximum thickness Dn of the surface layer preferably ranges from not less than 2D/3 to not greater than 4D/3.

The resin in the photosensitive layer mentioned above means the resin included in the top layer of the photosensitive layer, which top layer contacts the surface layer, when the photosensitive layer has a multi-layer structure.

Then the influence of the structure of the interfacial portion between the surface layer and the photosensitive layer on the photoreceptor properties will be explained.

At first, the influence on the mechanical durability of the photoreceptor will be explained.

When the solvent included in the surface layer coating liquid does not dissolve the photosensitive layer (in particular the resin in the photosensitive layer), the surface layer and the photosensitive layer have a discontinuous structure as shown in FIG. 1C. When a photoreceptor having such a structure is repeatedly used for a long period of time, the surface layer peels from the photosensitive layer from the edge portions of the photoreceptor because the adhesion of the surface layer to the photosensitive layer is weak.

To the contrary, when the solvent in the surface layer coating liquid including a solvent dissolving the photosensitive layer (in particular the resin in the photosensitive layer), the surface layer and the photosensitive layer have a continuous structure as shown in FIGS. 1A and 1B. When a photoreceptor having such a structure is repeatedly used for a long period of time, the peeling problem can be avoided because the adhesion of the surface layer to the photosensitive layer is strong. This is because the lower portion of the surface layer is mixed with the upper portion of the photosensitive layer.

Then the influence of the structure on the electrophotographic properties of the photoreceptor and image qualities of the images produced by the photoreceptor will be explained.

The photoreceptor in which the surface layer and the photosensitive layer have a discontinuous structure, the image qualities of initial images are good. However, in this case the CTM in the CTL tends to crystallize. When the CTM crystallizes, the resultant photoreceptor produces undesired images even in the initial stage. In addition, when such a photoreceptor is repeatedly used, charge injection from the photosensitive layer to the surface layer is obstructed, resulting in increase of the lighted-area potential of the photoreceptor, and thereby the image qualities are deteriorated (e.g., the image density decreases and background fouling occurs).

In contrast, when the photoreceptor and surface layer have a continuous structure, the movement of the charges from the photosensitive layer to the surface layer is not obstructed, and thereby the increase of the lighted-area potential can be prevented even if the photoreceptor is repeatedly used. However, when the surface layer is excessively mixed with the photoreceptor, the image qualities also deteriorate.

On the other hand, when a photoreceptor has a property such that a very uniform potential is formed on the entire surface thereof when the photoreceptor is charged, the resultant solid image has an edge effect as mentioned above. Namely, at an edge portion of such very uniform electrostatic latent solid image, electric flux lines erect, and thereby a larger amount of toner particles are adhered to the edge portion than in the other portions. Therefore, problems occur such that the line of the edge portion widens and toner scattering occurs around the solid image.

The present inventors discover that such problems can be prevented by forming microscopically uneven potential on the surface of the photoreceptor. In order to form microscopically uneven potential on the surface of the photoreceptor, the surface layer and photosensitive layer preferably have a proper continuous structure. Namely, by properly dissolving the photosensitive layer (particularly the resin therein) by the solvent included in the surface layer coating liquid, the resultant surface layer and photosensitive layer have a proper continuous structure, i.e., the boundary area of the surface layer and photosensitive layer becomes microscopically uneven, and thereby microscopically uneven potential can be formed on the surface of resultant the photoreceptor. Thus, the problems such that the line of the edge portion widens and toner scattering occurs around the solid image can be prevented.

As mentioned above, the photoreceptor in which the surface layer and photosensitive layer have a continuous structure has properties different from those of the photoreceptor in which the surface layer and photosensitive layer have a discontinuous structure. The present inventors discover that the object of the present invention can be attained by a photoreceptor in which the surface layer and photosensitive layer have a continuous structure and in which the standard deviation a of the maximum thickness is not greater than one fifth of the average maximum thickness D (i.e., D/5). Namely, a photoreceptor in which the surface layer and photosensitive layer have a continuous structure such that the photosensitive layer and the surface layer properly mixed with each other at the boundary portion has good mechanical durability and electrophotographic properties and can produce images having good image qualities.

The degree of mixing of the photosensitive layer with the surface layer at their boundary portion can be represented by the standard deviation σ. When the mixing degree is large, the standard deviation of the maximum thickness becomes large. To the contrary, when the mixing degree is small, the standard deviation also becomes small.

Figure 2:
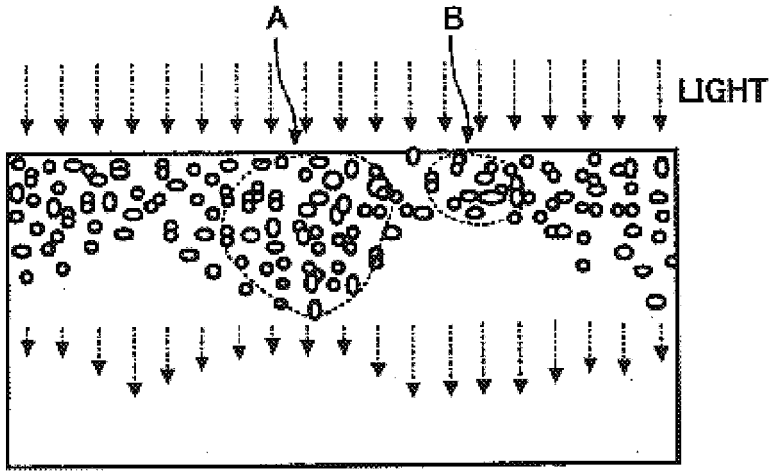
FIG. 2 is a schematic cross-sectional view for explaining how an uneven light quantity phenomenon occurs in a photoreceptor in which a surface layer and a photosensitive layer have a continuous structure.

As illustrated in FIG. 2, when imagewise light irradiates the surface of a photoreceptor, part of incident light is scattered by the filler particles in the surface layer, resulting in decrease of the light quantity. When a photoreceptor has a large standard deviation of the maximum thickness, this light scattering is unevenly performed. Namely, in FIG. 2, at a point A in which the maximum thickness is large, the quantity of transmitted light is relatively small compared to the light quantity at a point B in which the maximum thickness is small. Thus imagewise light having uneven light quantity reaches the photosensitive layer, and thereby charges are also unevenly generated at the photosensitive layer. Namely, when the standard deviation of the maximum thickness of the surface layer is large, the quantity of light reaching the photoreceptor becomes uneven and the quantity of generated charges also becomes uneven.

Figure 3A:
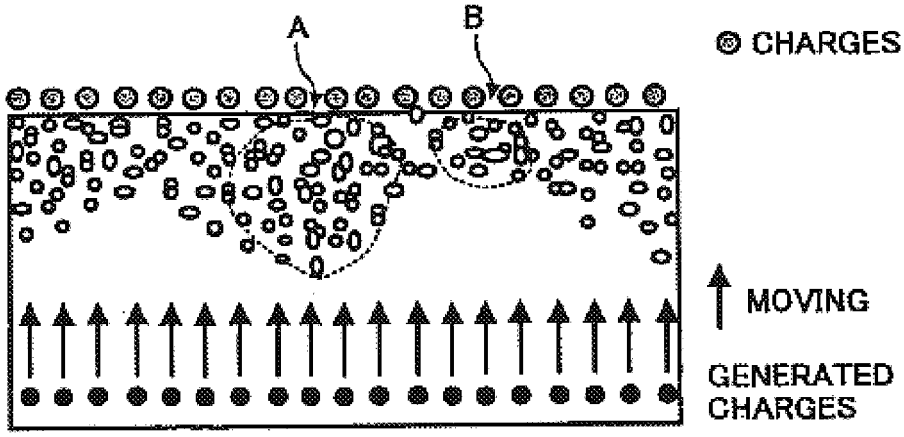
FIGS. 3A and 3B are schematic cross-sectional views for explaining how an uneven charge trapping phenomenon occurs in a photoreceptor in which a surface layer and a photosensitive layer have a continuous structure.
Figure 3B:
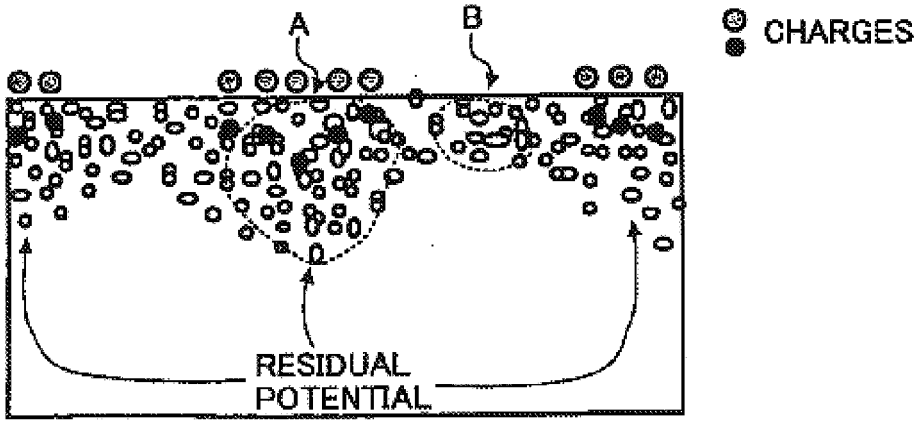

As illustrated in FIGS. 3A and 3B, the charges generated in the photosensitive layer move through the surface layer. The charges moving the surface layer are trapped by the filler particles, resulting in formation of residual potential. When the maximum thickness is large, the charges generated in the photosensitive layer and moving upwardly tend to be trapped by the surface layer. In contrast, when the maximum thickness is small, the charges generated in the photosensitive layer tend to be hardly trapped by the surface layer. Namely, when the standard deviation of the maximum thickness is large, charges are unevenly formed on the surface of the photoreceptor.

Thus, due to uneven light scattering and uneven charge trapping, charges are unevenly formed on the surface of the photoreceptor, resulting in formation of an uneven visual (i.e., toner) image.

Figure 4A:
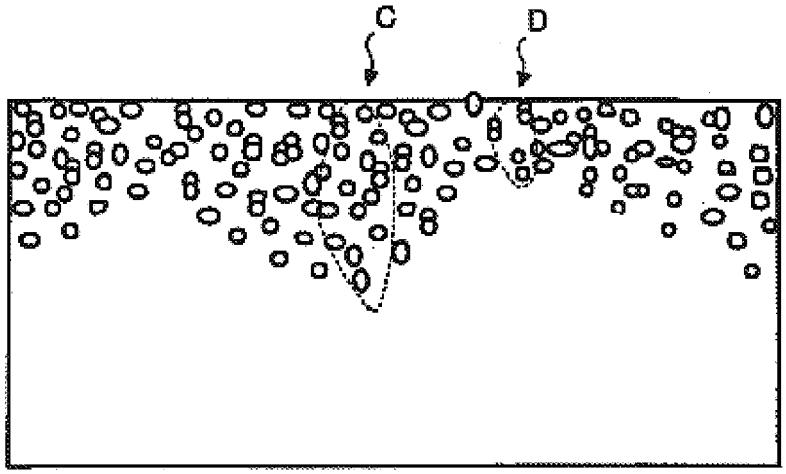
FIGS. 4A and 4B are schematic cross-sectional views for explaining how an uneven abrasion phenomenon occurs in a photoreceptor in which a surface layer and a photosensitive layer have a continuous structure.
Figure 4B:
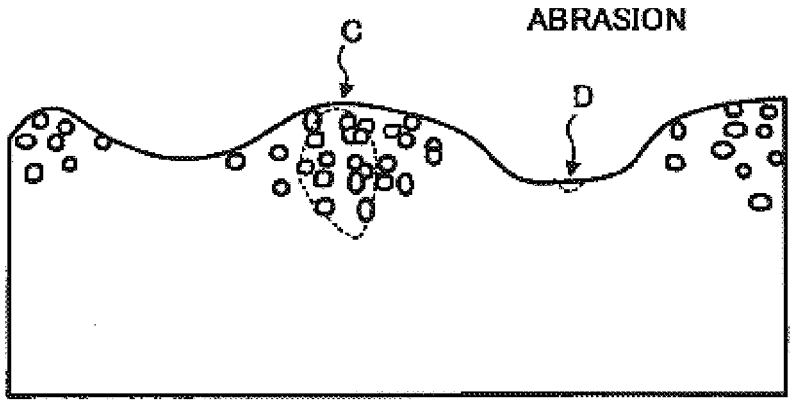

In addition, as illustrated in FIGS. 4A and 4B, at a portion C of a photoreceptor having a large maximum thickness, the abrasion speed of the surface layer is slow whereas at a portion D of the photoreceptor having a small maximum thickness, the abrasion speed is fast. Therefore, when the standard deviation is large, the abrasion of the surface layer becomes uneven. Thus, uneven density images are produced.

As a result of the investigation of the present inventors, the following knowledge can be obtained.

When the surface layer and photosensitive layer have a continuous structure and the standard deviation a of the average maximum thickness D of the surface layer is not greater than one fifth of the average thickness D (i.e., D/5), the resultant photoreceptor has good properties. In addition, when the standard deviation is not greater than one seventh of the average maximum thickness D (i.e., D/7), the resultant photoreceptor has better properties.

It is preferable that the standard deviation is small. However, when the standard deviation is 0, the surface layer and photosensitive layer have a discontinuous structure and therefore it is not preferable.

Therefore it is preferable that the preparation conditions of the surface layer coating liquid and coating conditions of the coating liquid, environmental conditions during the coating operations, etc., should be properly controlled such that the following relationship is satisfied:

$$\sigma \leqq D/5,$$

and preferably, the following relationship is satisfied:

$$\sigma \leqq D/7.$$

Next, the photoreceptor of the present invention will be explained referring to drawings.

Figure 5:
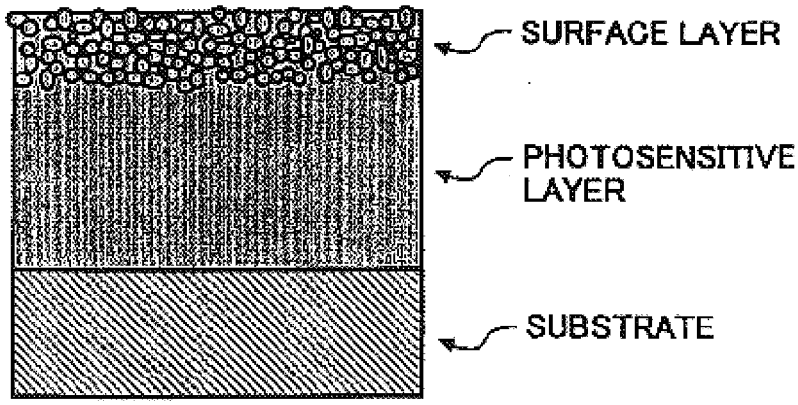
FIGS. 5 to 7 are schematic cross-sectional views of embodiments of the photoreceptor of the present invention.

FIG. 5 is a schematic cross sectional view illustrating an embodiment of the photoreceptor of the present invention. In the photoreceptor, a single-layer photosensitive layer including a CGM and a CTM as main components is formed on an electroconductive substrate, and a surface protective layer is formed on the photosensitive layer.

Figure 6:
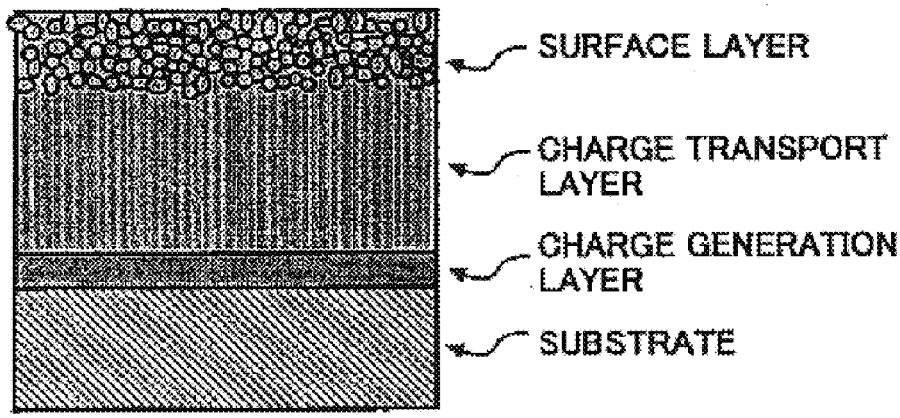

FIG. 6 is a schematic cross sectional view illustrating another embodiment of the photoreceptor of the present invention. In the photoreceptor, a CGL including a CGM as a main component and a CTL including a CTM as a main component are overlaid on an electroconductive substrate, and in addition a surface protective layer is formed on the CTL.

Figure 7:
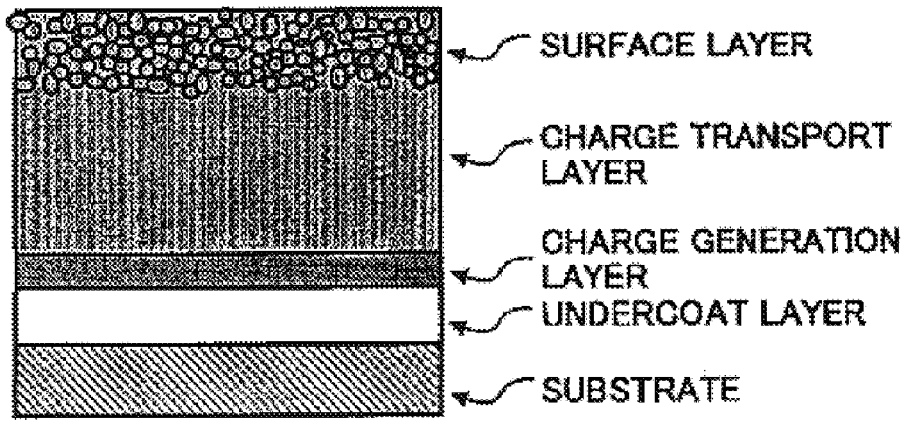

FIG. 7 is a schematic cross sectional view illustrating yet another embodiment of the photoreceptor of the present invention. In the photoreceptor, an undercoat layer is formed on an electroconductive substrate, and a CGL including a CGM as a main component and a CTL including a CTM as a main component are overlaid thereon. In addition, a surface layer (i.e., a protective layer) is formed on the CTL.

The structure of the photoreceptor of the present invention is not limited to the structures illustrated in FIGS. 5 to 7. For example, in FIGS. 6 and 7, the CGL may be formed on the CTL.

Suitable materials for use as the electroconductive substrate include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel can be used. A metal cylinder can also be used as the substrate 31, which is prepared by tubing a metal such as aluminum, aluminum alloys, nickel and stainless steel by a method such as impact ironing or direct ironing, and then treating the surface of the tube by cutting, super finishing, polishing and the like treatments. Further, endless belts of a metal such as nickel, stainless steel and the like, which have been disclosed, for example, in Japanese Laid-Open Patent Publication No. 52-36016, can also be used as the substrate.

Furthermore, substrates, in which a coating liquid including a binder resin and an electroconductive powder is coated on the supports mentioned above, can be used as the substrate. Specific examples of such an electroconductive powder include carbon black, acetylene black, powders of metals such as aluminum, nickel, iron, nichrome, copper, zinc, silver and the like, and metal oxides such as electroconductive tin oxides, ITO and the like. Specific examples of the binder resin include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like resins.

Such an electroconductive layer can be formed by coating a coating liquid in which an electroconductive powder and a binder resin are dispersed or dissolved in a proper solvent such as tetrahydrofuran, dichloromethane, methyl ethyl ketone, toluene and the like solvent, and then drying the coated liquid.

In addition, substrates, in which an electroconductive resin film is formed on a surface of a cylindrical substrate using a heat-shrinkable resin tube which is made of a combination of a resin such as polyvinyl chloride, polypropylene, polyesters, polyvinylidene chloride, polyethylene, chlorinated rubber and fluorine-containing resins, with an electroconductive material, can also be used as the substrate.

Next, the photosensitive layer will be explained.

In the present invention, the photosensitive layer may have a single-layer structure or a multi-layer structure. The photosensitive layer having a charge generation layer (CGL) and a charge transport layer (CTL) will be explained at first.

The CGL includes a CGM as a main component. Suitable CGMs include known CGMs.

Specific examples of such CGMs include azo pigments such as monoazo pigments, disazo pigments, and trisazo pigments; perylene pigments, perynone pigments, quinacridone pigments, quinone type condensed polycyclic compounds, squaric acid type dyes, phthalocyanine pigments, naphthalocyanine pigments, azulenium salt dyes, and the like pigments and dyes. These CGMs can be used alone or in combination.

Among these pigments and dyes, azo pigments and phthalocyanine pigments are preferably used. In particular, azo pigments having the following formula (1) and titanyl phthalocyanine having an X-ray diffraction spectrum in which a highest peak is observed at Bragg 2 θ angle of 27.2°±0.2° when a specific X-ray of Cu-Kα having a wavelength of 1.541 Å irradiates the titanyl phthalocyanine pigment are preferably used.

(1)

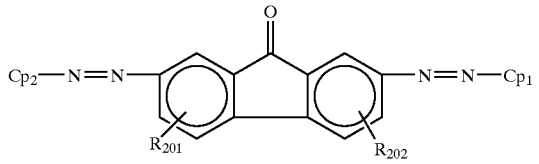

wherein $R_{201}$ and $R_{202}$ independently represent a hydrogen atom, a halogen atom, an alkyl group, an alkoxyl group, or a cyano group; and $Cp_1$ and $Cp_2$ independently represent a residual group of a coupler, which has the following formula (2):

(2)

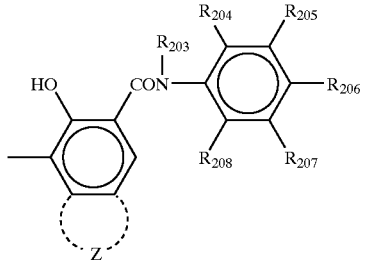

wherein $R_{203}$ represents a hydrogen atom, an alkyl group such as a methyl group and an ethyl group, or an aryl group such as a phenyl group; $R_{204}$, $R_{205}$, $R_{206}$, $R_{207}$ and $R_{208}$ independently represent a hydrogen atom, a nitro group, a cyano group, a halogen atom such as a fluorine atom, a chlorine atom, a bromine atom and an iodine atom, an alkyl group such as a trifluoromethyl group, a methyl group and an ethyl group, an alkoxyl group such as a methoxy group and an ethoxy group, a dialkylamino group or a hydroxyl group; and Z represents an atomic group needed for constituting a substituted or unsubstituted aromatic carbon ring or a substituted or unsubstituted aromatic heterocyclic ring.

The CGL can be prepared, for example, by the following method:

(1) a CGM is mixed with a proper solvent optionally together with a binder resin;

(2) the mixture is dispersed using a ball mill, an attritor, a sand mill or a supersonic dispersing machine to prepare a coating liquid; and (3) the coating liquid is coated on an electroconductive substrate and then dried to form a CGL.

Suitable binder resins, which are optionally used for the CGL coating liquid, include polyamide, polyurethane, epoxy resins, polyketone, polycarbonate, silicone resins, acrylic resins, polyvinyl butyral, polyvinyl formal, polyvinyl ketone, polystyrene, polysulfone, poly-N-vinylcarbazole, polyacrylamide, polyvinyl benzal, polyester, phenoxy resins, vinyl chloride-vinyl acetate copolymers, polyvinyl acetate, polyphenylene oxide, polyamides, polyvinyl pyridine, cellulose resins, casein, polyvinyl alcohol, polyvinyl pyrrolidone, and the like resins.

The content of the binder resin in the CGL is preferably from 0 to 500 parts by weight, and preferably from 10 to 300 parts by weight, per 100 parts by weight of the CGM included in the CGL.

Suitable solvents for use in the CGL coating liquid include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, ligroin, and the like solvents. In particular, ketone type solvents, ester type solvents and ether type solvents are preferably used.

The CGL coating liquid can be coated by a coating method such as dip coating, spray coating, bead coating, nozzle coating, spinner coating and ring coating. The thickness of the CGL is preferably from 0.01 to 5 μm, and more preferably from 0.1 to 2 μm.

Then the CTL will be explained.

The CTL can be formed, for example, by the following method:

(1) a CTM and a binder resin are dispersed or dissolved in a proper solvent to prepare a CTL coating liquid; and (2) the CTL coating liquid is coated on the CGL and dried to form a CTL.

The CTL may include additives such as plasticizers, leveling agents, antioxidants and the like, if desired.

CTMs are classified into positive-hole transport materials and electron transport materials.

Specific examples of the electron transport materials include electron accepting materials such as chloranil, bromanil, tetracyanoethylene, tetracyanoquinodimethane, 2,4,7-trinitro-9-fluorenon, 2,4,5,7-tetranitro-9-fluorenon, 2,4,5,7-tetanitroxanthone, 2,4,8-trinitrothioxanthone, 2,6,8-trinitro-4H-indeno[1,2-b]thiophene-4-one, 1,3,7-trinitrodibenzothiphene-5,5-dioxide, benzoquinone derivatives and the like.

Specific examples of the positive-hole transport materials include known materials such as poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and the like.

These CTMs can be used alone or in combination.

Specific examples of the binder resin for use in the CTL include known thermoplastic resins, thermosetting resins and photo-crosslinking resins, such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the like.

The content of the CTM in the CTL is preferably from 20 to 300 parts by weight, and more preferably from 40 to 150 parts by weight, per 100 parts by weight of the binder resin included in the CTL. The thickness of the CTL is preferably not greater than 25 $\mu$m in view of resolution of the resultant images and response (i.e., photosensitivity) of the resultant photoreceptor. In addition, the thickness of the CTL is preferably not less than 5 $\mu$m in view of charge potential. The lower limit of the thickness changes depending on the image forming system for which the photoreceptor is used (in particular, depending on the charge potential to be formed on the photoreceptor by the image forming apparatus).

Suitable solvents for use in the CTL coating liquid include tetrahydrofuran, dioxane, toluene, dichloromethane, monochlorobenzene, dichloroethane, cyclohexanone, methyl ethyl ketone, acetone and the like solvents.

The CTL may include additives such as plasticizers and leveling agents. Specific examples of the plasticizers include known plasticizers, which are used for plasticizing resins, such as dibutyl phthalate, dioctyl phthalate and the like. The addition quantity of the plasticizer is 0 to 30% by weight of the binder resin included in the CTL.

Specific examples of the leveling agents include silicone oils such as dimethyl silicone oil, and methyl phenyl silicone oil; polymers or oligomers including a perfluoroalkyl group in their side chain; and the like. The addition quantity of the leveling agents is 0 to 1% by weight of the binder resin included in the CTL.

Next, the single-layer photosensitive layer will be explained. The photosensitive layer can be formed by coating a coating liquid in which a CGM, a CTM and a binder resin are dissolved or dispersed in a proper solvent, and then drying the coated liquid. The photosensitive layer may include the CTMs mentioned above to form a functionally-separated photosensitive layer. The photosensitive layer may include additives such as plasticizers, leveling agents and antioxidants.

Suitable binder resins for use in the photosensitive layer include the resins mentioned above for use in the CTL. The resins mentioned above for use in the CGL can be added as a binder resin.

The content of the CGM is preferably from 5 to 40 parts by weight per 100 parts by weight of the binder resin included in the photosensitive layer. The content of the CTM is preferably from 0 to 190 parts by weight, and more preferably from 50 to 150 parts by weight, per 100 parts by weight of the binder resin included in the photosensitive layer.

The single-layer photosensitive layer can be formed by coating a coating liquid in which a CGM and a binder and optionally a CTM are dissolved or dispersed in a solvent such as tetrahydrofuran, dioxane, dichloroethane, cyclohexane, etc. by a coating method such as dip coating, spray coating, bead coating, or the like. The thickness of the single-layer photosensitive layer is preferably from 5 to 25 $\mu$m.

In the photoreceptor of the present invention, an undercoat layer may be formed between the electroconductive substrate and the photosensitive layer as shown in FIG. 7.

The undercoat layer includes a resin as a main component. Since a photosensitive layer is typically formed on the undercoat layer by coating a coating liquid including an organic solvent, the resin in the undercoat layer preferably has good resistance to general organic solvents.

Specific examples of such resins include water-soluble resins such as polyvinyl alcohol resins, casein and polyacrylic acid sodium salts; alcohol soluble resins such as nylon copolymers and methoxymethylated nylon resins; and thermosetting resins capable of forming a three-dimensional network such as polyurethane resins, melamine resins, alkyd-melamine resins, epoxy resins and the like.

The undercoat layer may include a fine powder of metal oxides such as titanium oxide, silica, alumina, zirconium oxide, tin oxide and indium oxide to prevent occurrence of moire in the recorded images and to decrease residual potential of the photoreceptor.

The undercoat layer can also be formed by coating a coating liquid using a proper solvent and a proper coating method mentioned above for use in the photosensitive layer.

The undercoat layer may be formed using a silane coupling agent, titanium coupling agent or a chromium coupling agent.

In addition, a layer of aluminum oxide which is formed by an anodic oxidation method and a layer of an organic compound such as polyparaxylylene or an inorganic compound such as $SiO_2$, $SnO_2$, $TiO_2$, indium tin oxide (ITO) or $CeO_2$ which is formed by a vacuum evaporation method is also preferably used as the undercoat layer.

The thickness of the undercoat layer is preferably 0 to 5 $\mu$m.

In the photoreceptor of the present invention, the protective layer is formed overlying the photosensitive layer as a surface layer to protect the photosensitive layer.

Suitable materials for use in the protective layer include ABS resins, ACS resins, olefin-vinyl monomer copolymers, chlorinated polyethers, aryl resins, phenolic resins, polyacetal, polyamides, polyamideimide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins and the like.

As mentioned above, the protective layer includes a filler such as organic fillers and inorganic fillers to improve the abrasion resistance of the photoreceptor.

Specific examples of the organic fillers include powders of fluorine-containing resins such as polytetrafluoroethylene, silicone resin powders and carbon powders. Specific examples of the inorganic fillers include powders of metals such as copper, tin, aluminum and indium; metal oxides such as silica, tin oxide, zinc oxide, titanium oxide, indium oxide, antimony oxide, bismuth oxide, tin oxide doped with antimony, indium oxide doped with tin; potassium titanate, etc. Among these fillers, inorganic fillers are preferably used in view of hardness. In particular, silica, aluminum oxide and titanium oxide are preferably used.

The average primary particle diameter of the filler included in the protective layer is preferably from 0.01 to 0.5 $\mu$m to improve the light-transmittance and abrasion resistance of the protective layer. When the average primary particle diameter of the filler used is too small, the abrasion resistance of the protective layer and the dispersibility of the filler in a coating liquid deteriorate. To the contrary, when the average primary particle diameter of the filler used is too large, the amount of the precipitated filler increases in a coating liquid and a toner filming problem such that a film of the toner used is formed on the protective layer tends to occur.

The more the concentration of the filler included in the protective layer, the better the abrasion resistance of the protective layer. However, when the concentration is too high, adverse affects are produced such that residual potential of the resultant photoreceptor increases and transmittance of the protective layer against the light used for writing images deteriorates. Therefore the concentration is preferably not greater than 50% by weight, and more preferably not greater than 30% by weight, based on total solid components of the protective layer.

The lower limit of the filler concentration should be determined depending on the abrasion resistance of the filler used. In general, the filler content is preferably not less than 5% by weight.

These fillers are preferably treated with at least one surface treating agent to improve the dispersibility thereof. Deterioration of dispersibility of a filler included in the protective layer not only increases residual potential but also decreases transparency of the protective layer, generates coating deficiencies, and deteriorates abrasion resistance of the protective layer, and thereby a big problem occurs such that a photoreceptor having good durability and capable of producing good images cannot be provided.

Suitable surface treating agents include known surface treating agents, but surface treating agents which can maintain the insulating properties of the filler to be used in the protective layer are preferable. Specific examples of such surface treating agents include titanate coupling agents, aluminum coupling agents, zircoaluminate coupling agents, higher fatty acids, and combinations of these agents with silane coupling agents; and $Al_2O_3$, $TiO_2$, $ZrO_2$, silicones, aluminum stearate, and their mixtures. These are preferable because of being able to impart good dispersibility to fillers and to prevent the blurred image problem.

When a filler treated with a silane coupling agent is used, the blurred image problem tends to be caused. However, when used in combination with the surface treating agents mentioned above, there is a case in which the problem can be avoided.

The content of a surface treating agent in a coated filler, which depends on the primary particle diameter of the filler, is from 3 to 30% by weight, and more preferably from 5 to 20% by weight. When the content is too low, good dispersibility cannot be obtained. To the contrary, when the content is too high, residual potential seriously increases.

These fillers can be used alone or in combination.

The average maximum thickness D is preferably from 1.0 to 8.0 $\mu$m. Since the photoreceptor is repeatedly used, the photoreceptor has to have high mechanical durability and high abrasion resistance. In image forming apparatus, ozone and NOx gasses are produced by chargers, etc., and adhere to the photoreceptor used therein. When these substances are present on the photoreceptor, blurred images are produced. In order to prevent such a blurred image problem, the surface of the photoreceptor is preferably abraded to some extent. When considering that a photoreceptor is repeatedly used for a long period of time, the protective layer preferably has a thickness not less than 1.0 $\mu$m. When the thickness is greater than 8.0 $\mu$m, problems such that residual potential of the resultant photoreceptor tends to increase and fine dot reproducibility of the resultant images deteriorates.

The filler in the protective layer coating liquid can be dispersed using a proper dispersing machine. The average particle diameter of the filler in the protective layer coating liquid is preferably not greater than 1 $\mu$m, and more preferably not greater than 0.5 $\mu$m in view of light transmittance of the protective layer.

In the photoreceptor of the present invention, a filler is dispersed in the protective layer and the protective layer and the photosensitive layer have a continuous structure as shown in FIGS. 1A and 1B. Provided that the average maximum thickness of the protective layer is D and the standard deviation of the maximum thickness is $\sigma$, the following relationship is satisfied:

$$\sigma \leq D/5,$$

and preferably the following relationship is satisfied:

$$\sigma \leq D/7.$$

The standard deviation a is preferably small, however, when the standard deviation is 0, the protective layer and photosensitive layer have a discontinuous structure and therefore it is not preferable.

The average maximum thickness D of the protective layer and standard deviation $\sigma$ of the maximum thickness are measured with respect to a part of the image forming portion of the photoreceptor.

The protective layer can be formed by a coating method such as dip coating, ring coating and spray coating methods. Among these coating methods, a spray coating method in which a misty coating liquid formed by spraying the coating liquid from a nozzle having a fine opening is adhered on the surface of the photosensitive layer to form a layer thereon is preferably used.

Then the spray coating method will be explained in detail.

When a surface layer coating liquid whose solvent does not dissolve the photosensitive layer is coated on the photosensitive layer by the spray coating method, the resultant surface layer does not mixed with the photosensitive layer at their boundary portion. Therefore the surface layer and photosensitive layer have a discontinuous structure, i.e., a clear interface is formed therebetween. When a photoreceptor has such a discontinuous structure, image qualities of the images initially produced by the photoreceptor are good. However, such a photoreceptor has poor mechanical durability and unstable electrophotographic properties, and therefore when the photoreceptor is repeatedly used for a long period of time, undesired images are produced. Therefore, the surface layer coating liquid has to include a solvent dissolving at least the resin in the photosensitive layer.

When a surface layer coating liquid including a solvent capable of dissolving the photosensitive layer is coated on the photosensitive layer by the spray coating method, the resultant surface layer is mixed with the photosensitive layer at their boundary portion. Therefore the surface layer and photosensitive layer have a continuous structure. The photoreceptor having such a continuous structure has good mechanical durability and stable electrophotographic properties. However, when the surface layer is excessively mixed with the photosensitive layer, image qualities deteriorate.

Therefore, it is preferable that a surface layer coating liquid including a solvent capable of dissolving the photosensitive layer is coated by a spray coating method such that the surface layer and photosensitive layer have a continuous structure as specified above. Such a photoreceptor has good mechanical durability and stable electrophotographic properties, and therefore can produce images having good image qualities even when repeatedly used for a long period of time.

The degree of mixing of the surface layer with the photosensitive layer can be influenced by the time from a time at which the coating liquid adheres on the photosensitive layer to a time at which the content of the solvent dissolving the resin in the photosensitive layer included in the surface layer coating liquid reaches a certain content. Namely, the degree of mixing is largely influenced by the quantity of the coating liquid adhered on the surface of the photoreceptor and the evaporating speed of the solvent included in the coating liquid.

When a solvent which has low evaporating speed is used in the coating liquid, the photosensitive layer is easily dissolved by the surface layer coating liquid.

In the present invention, the evaporation speed of the solvent in the surface layer coating liquid is mainly controlled by the following factors:

(1) conditions of the surface layer coating liquid, such as species of the solvent used, and solid content of the coating liquid;

(2) conditions of the spray coating method used, such as discharge rate, discharge pressure, feeding speed of spray gun, and the number of coating times; and (3) environmental conditions in coating, such as temperature, and amount of discharged air.

The protective layer (i.e., the surface layer) of the present invention is preferably formed by the following method.

A surface coating liquid including a binder resin, a filler and a solvent, which can dissolve the binder resin and the resin present on the surface of the photosensitive layer, is coated on the photosensitive layer by a spray coating method. At this point, the following relationship is preferably satisfied:

$$1.2<A/B<2.0$$

wherein A represents a weight of a film of the surface layer per a unit area, which is prepared by coating the surface layer coating liquid directly on the electroconductive substrate to be used by the spray coating method and then drying the coated liquid at room temperature for 60 minutes, and B represents a weight of the coated film of the surface layer per the unit area, which is prepared by perfectly drying the film.

At this point, the "perfectly dried film" means a film of the surface layer which is dried by being heated such that the solvent remaining therein is not greater than 1000 ppm.

Next, the way how to measure the weight (i.e., A) of the coated film which has been settled for 60 minutes after being coated, and the weight (i.e., B) of the perfectly dried film will be explained.

(1) the weight (G1) of a cylinder serving as a an electroconductive substrate is measured;

(2) a surface layer coating liquid is coated on the periphery surface of the cylinder by a spray coating method to form a film of the surface layer on the cylinder;

(3) the coated film is settled for 60 minutes while not being specially heated and then the weight (G2) of the cylinder having the coated film is measured; and (4) the coated film is heated to prepare a perfectly-dried surface layer and the weight (G3) of the cylinder having the perfectly-dried surface layer is measured.

At this point, A can be determined as the difference between G2 and G1 (G2−G1), and B can be determined as the difference between G3 and G1 (G3−G1).

When the surface layer is formed under a condition such that the ratio A/B is less than 1.2, the misty coating liquid becomes unstable. Namely, when the coating liquid is sprayed, the misty coating liquid tends to solidify. The solidified particles of the coating liquid adhere to the surface of the photosensitive layer, and thereby undesired images tend to be produced.

When surface layer is formed under a condition such that the ratio A/B is greater than 2.0, the mixing of the surface layer with the photosensitive layer tends to excessively proceed. Namely, the standard deviation $\sigma$ becomes large. As mentioned above, when the standard deviation is greater than D/5, various properties of the resultant photoreceptor deteriorate.

Thus, by forming the surface layer while controlling the coating conditions such that the ratio A/B is greater than 1.2 and less than 2.0, the standard deviation falls into the preferable range mentioned above, and thereby a photoreceptor having good properties can be prepared.

Then the surface layer coating liquid will be explained.

The surface layer coating liquid includes at least one solvent which can dissolve the resin included in the photosensitive layer and the resin in the surface layer coating liquid. The solvent is used alone or in combination with another solvent. When the solvent has high volatility, the coating liquid tends to solidify when being sprayed, and the solidified particles adhere on the photosensitive layer, resulting in formation of coating defects.

In contrast, when the solvent has low volatility, the surface of the photosensitive layer tends to be largely dissolved, resulting in excessive increase of the standard deviation a of the maximum thickness. Therefore it is preferable to use a mixture of a solvent having high volatility and a solvent having low volatility. The boiling point of the solvent having high volatility is preferably from 50° C. to 80° C. The boiling point of the solvent having low volatility is preferably from 130° C. to 160 ° C. By using a surface layer coating liquid including such a mixture solvent, mixing of the surface layer with photosensitive layer can be easily controlled.

When only a solvent having a boiling point not greater than 80° C. is used in the surface coating liquid, the ratio A/B tends to become lower than 1.2, resulting in occurrence of the problems mentioned above. In contrast, when only a solvent having a boiling point not less than 80° C. is used in the surface coating liquid, the coated liquid tends to flow on the surface of the photosensitive layer during preliminary drying process in which the coated liquid is dried at room temperature, resulting in formation of the surface layer having an undesired structure. In particular, when only a solvent having a boiling point not less than 130° C., not only the surface layer has an undesired structure, but also the ratio A/B tends to become greater than 2.0, resulting in occurrence of the problems mentioned above.

Specific examples of the solvent having a boiling point of from 50° C. to 80° C. include tetrahydrofuran and dioxolan. Specific examples of the solvent having a boiling point of from 130° C. to 160° C. include cyclohexanone, cyclopentanone, and anisole.

When a surface coating liquid including an organic solvent having a boiling point of from 50° C. to 80° C. and another organic solvent having a boiling point of from 130° C. to 160° C. is coated to form a surface layer on a photosensitive layer, the coated liquid is at first preliminarily dried at room temperature. Then the coated surface layer is heated to be perfectly dried.

The properties of the photoreceptor largely change depending on the heating conditions. It is preferable that the drying temperature is from 130° C. to 160° C. and the drying time is from 10 minutes to 60 minutes. When the drying temperature is too low or the drying time is too short, a large amount of the solvent remains in the photoreceptor, resulting in increase of the lighted-area potential at initial stage of the resultant photoreceptor. In addition, when the photoreceptor is repeatedly used, potential formed on the photoreceptor varies, and thereby the image qualities largely vary. In contrast, when the drying temperature is too high or the drying time is too long, the crystallinity or crystal form of the pigment in the CGL (photosensitive layer) tends to change and/or low molecular weight components such as an antioxidant and a plasticizer tends to release from the CTL (photosensitive layer). Thereby photosensitivity and charge properties of the resultant photoreceptor deteriorate.

When a surface coating liquid including a solvent having a boiling point of from 50° C. to 80° C. and another organic solvent having a boiling point of from 130° C. to 160° C. is used, the preliminary drying conditions are such that the surface-layer coated photoreceptor is settled for more than 5 minutes while being rotated under the same conditions as those in the spray coating process.

It is possible to control the film qualities of the surface layer by controlling the solid content of the surface layer coating liquid. When the solid content of the liquid coated on the photosensitive layer is low, it takes a relatively long time until the coated liquid is dried. Therefore the surface of the photosensitive layer tends to be largely dissolved, resulting in increase of the standard deviation a of the maximum thickness. In contrast, when the solid content is high, the sprayed coating liquid tends to solidify in the misty state, resulting in adhesion of solidified particles on the photosensitive layer, and thereby coating defects are formed in the resultant surface layer. Therefore, the solid content of the surface layer is preferably from 3.0 to 6.0% by weight.

Then the spray coating conditions will be explained.

The spray coating conditions change depending on the spray gun used. Therefore the following conditions are the typical conditions.

The diameter of the opening of the spray gun is preferably from 0.5 to 0.8 mm. When the diameter is out of this range, it is hard to prepare a coating liquid in a misty state, and therefore a film having good film qualities is hardly prepared.

The discharge rate of the coating liquid is preferably from 5 to 25 cc/min. When the discharge rate is low, the coating speed is slow, resulting in decrease of productivity. In contrast, when the discharge rate is high, there is a case in which the standard deviation becomes too large. In addition, the quantity of the coated liquid becomes large, and thereby the coated liquid tends to flow, resulting in formation of an uneven surface layer film.

The coating liquid discharging pressure (hereinafter referred to as discharging pressure) is preferably from 1.0 to 3.0 kg/cm$^2$. When the discharging pressure is too low, the diameter of the mist of the coating liquid is large, and thereby the coated layer tends to have an undesired structure. When the discharging pressure is too high, the mist bounces from the surface of the photosensitive layer, resulting in formation of a layer having an undesired structure and deterioration of film forming efficiency.

The revolution number of the photoreceptor on which the surface layer is to be formed is preferably from 120 to 640 rpm, and the feeding speed of the spray gun is preferably from 5 to 40 mm/sec. These conditions are off-balanced, the coated layer has an undesired spiral structure.

The distance between the spray gun and the photoreceptor on which the surface layer is to be formed is preferably from 3 to 15 cm. When the distance is too short, a stable mist cannot be formed, resulting in formation of a surface layer having an undesired structure. When the distance is too long, the efficiency of adhesion of the coating liquid on the surface of the photosensitive layer deteriorates.

The thickness of the coated liquid per one coating operation performed by a spray gun is preferably from 0.5 to 2.0 $\mu$m on a dry basis. When this single-coating-operation thickness is too thin, the desired surface film cannot be prepared even when the other coating conditions are controlled, and in addition productivity deteriorates. In contrast, when the thickness is too thick, the standard deviation a tends to become large, resulting in occurrence of the problems mentioned above.

The preferable condition of one of the factors mentioned above changes depending on the conditions of the other factors. Namely, when the condition of a factor is changed, there is a possibility that all the other factors have to be changed. The preferable conditions should be determined while considering the mist state of the coating liquid, the surface condition of the photoreceptor, the dispersion condition of the filler in the coating liquid, the adhesion efficiency of the sprayed coating liquid, etc.

As mentioned above, when a spray coating method is used, coating is preferably performed such that the ratio A/B is greater than 1.2 and less than 2.0 as mentioned above.

The method of forming the surface layer is not limited to the spray coating method mentioned above, and any coating methods can be used as long as the resultant surface layer has the desired film properties.

The protective layer (i.e., the surface layer) may include a CTM to decrease residual potential and improve the response of the resultant photoreceptor. Specific examples of the CTMs include the CTMs mentioned above for use in the CTL. When a low molecular weight CTM is used in the protective layer, the concentration of the CTM may be changed in the thickness direction of the protective layer. It is preferable that the concentration of the CTM at the surface of the protective layer is relatively low compared to that at the bottom of the protective layer, to improve the abrasion resistance thereof.

A charge transport polymer which has both a charge transport function and a binder function can be preferably used in the protective layer. A surface layer including such a charge transport polymer has good abrasion resistance.

Specific examples of the charge transport polymers include known charge transport polymers. Among the polymers, polycarbonate, polyurethane, polyester and polyether are preferably used. In particular, polycarbonate having a triarylamine group in its main chain and/or side chain is preferable. Among such polycarbonate, the polycarbonate having one of the following formulae (3) to (12) is preferable.

(3)

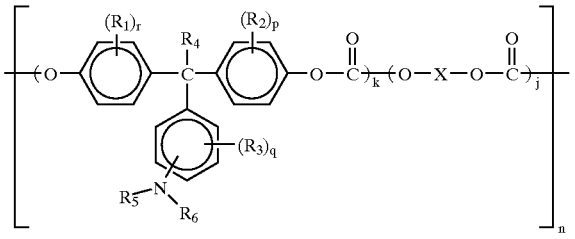

wherein $R_1$, $R_2$ and $R_3$ independently represent a substituted or unsubstituted alkyl group, or a halogen atom; $R_4$ represents a hydrogen atom, or a substituted or unsubstituted alkyl group; $R_5$, and $R_6$ independently represent a substituted or unsubstituted aryl group; r, p and q independently represent 0 or an integer of from 1 to 4; k is a number of from 0.1 to 1.0 and j is a number of from 0 to 0.9; n is an integer of from 5 to 5000; and X represents a divalent aliphatic group, a divalent alicyclic group or a divalent group having the following formula:

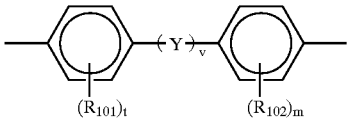

wherein $R_{101}$ and $R_{102}$ independently represent a substituted or unsubstituted alkyl group, a substituted or unsubstituted aryl group, or a halogen atom; t and m represent 0 or an integer of from 1 to 4; v is 0 or 1; and Y represents a linear alkylene group, a branched alkylene group, or a cyclic alkylene group, which has 1 to 12 carbon atoms, —O—, —S—, —SO—, —$SO_2$—, —CO—, —Co—O-Z-O—CO— (Z represents a divalent aliphatic group), or a group having the following formula:

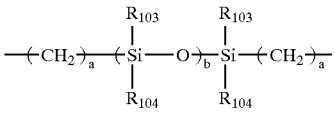

wherein a is an integer of from 1 to 20; b is an integer of from 1 to 2000; and $R_{103}$ and $R_{104}$ independently represent a substituted or unsubstituted alkyl group, or a substituted or unsubstituted aryl group, wherein $R_{101}$, $R_{102}$, $R_{103}$ and $R_{104}$ may be the same or different from the others.

(4)

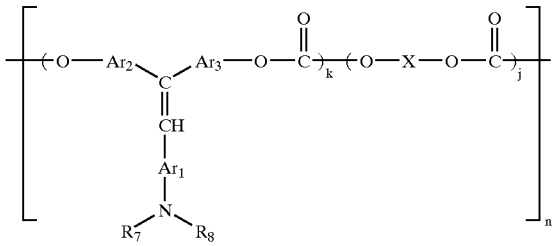

wherein $R_7$ and $R_8$ independently represent a substituted or unsubstituted aryl group; $Ar_1$, $Ar_2$ and $Ar_3$ independently represent an arylene group; and X, k, j and n are defined above in formula (3).

(5)

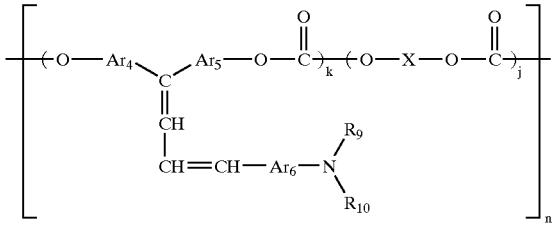

wherein $R_9$ and $R_{10}$ independently represent a substituted or unsubstituted aryl group; $Ar_4$, $Ar_5$ and $Ar_6$ independently represent an arylene group; and X, k, j and n are defined above in formula (3).

(6)

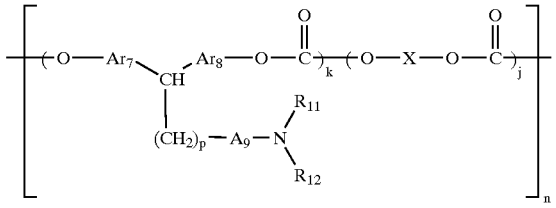

wherein $R_{11}$ and $R_{12}$ independently represent a substituted or unsubstituted aryl group; $Ar_7$, $Ar_8$ and $Ar_9$ independently represent an arylene group; p is an integer of from 1 to 5; and X, k, j and n are defined above in formula (3).

(7)

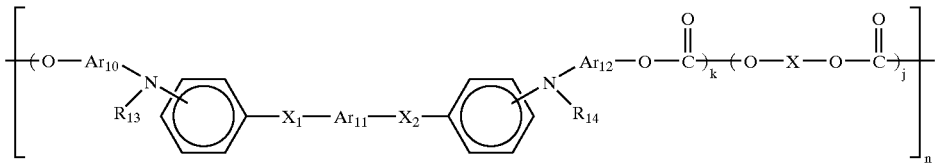

wherein $R_{13}$ and $R_{14}$ independently represent a substituted or unsubstituted aryl group; $Ar_{10}$, $Ar_{11}$ and $Ar_{12}$ independently represent an arylene group; $X_1$ and $X_2$ independently represent a substituted or unsubstituted ethylene group, or a substituted or unsubstituted vinylene group; and X, k, j and n are defined above in formula (3).

(8)

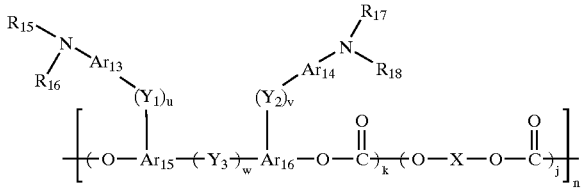

wherein $R_{15}$, $R_{16}$, $R_{17}$ and $R_{18}$ independently represent a substituted or unsubstituted aryl group; $Ar_{13}$, $Ar_{14}$, $Ar_{15}$ and $Ar_{16}$ independently represent an arylene group; $Y_1$, $Y_2$ and $Y_3$ independently represent a substituted or unsubstituted alkylene group, a substituted or unsubstituted cycloalkylene group, a substituted or unsubstituted alkyleneether group, an oxygen atom, a sulfur atom, or a vinylene group; u, v and w independently represent 0 or 1; and X, k, j and n are defined above in formula (3).

(9)

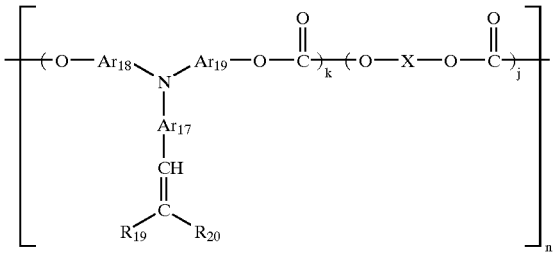

wherein $R_{19}$ and $R_{20}$ independently represent a hydrogen atom, or substituted or unsubstituted aryl group, and $R_{19}$ and $R_{20}$ optionally share bond connectivity to form a ring; $Ar_{17}$, $Ar_{18}$ and $Ar_{19}$ independently represent an arylene group; and X, k, j and n are defined above in formula (3).

(10)

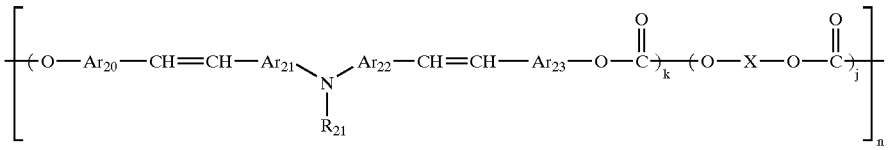

wherein $R_{21}$ represents a substituted or unsubstituted aryl group; $Ar_{20}$, $Ar_{21}$, $Ar_{22}$ and $Ar_{23}$ independently represent an arylene group; and X, k, j and n are defined above in formula (3).

(11)

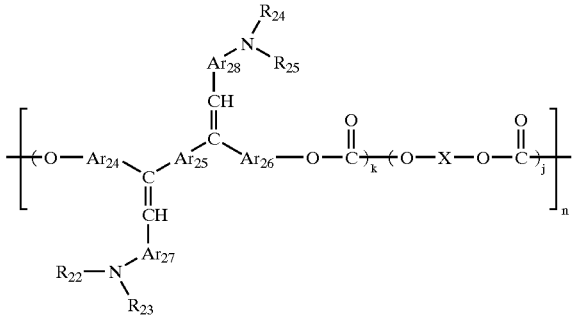

wherein $R_{22}$, $R_{23}$, $R_{24}$ and $R_{25}$ independently represent a substituted or unsubstituted aryl group; $Ar_{24}$, $Ar_{25}$, $Ar_{26}$, $Ar_{27}$ and $Ar_{28}$ independently represent an arylene group; and X, k, j and n are defined above in formula (3).

(12)

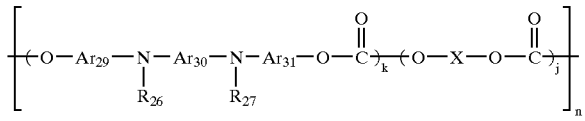

wherein $R_{26}$ and $R_{27}$ independently represent a substituted or unsubstituted aryl group; $Ar_{29}$, $Ar_{30}$ and $Ar_{31}$ independently represent an arylene group; and X, k, j and n are defined above in formula (3).

In the photoreceptor of the present invention, one or more additives such as antioxidants, plasticizers, lubricants, ultraviolet absorbents, low molecular weight charge transport materials and leveling agents can be used in one or more layers to improve the stability to withstand environmental conditions, namely to avoid decrease of photosensitivity and increase of residual potential of the resultant photoreceptor.

Suitable antioxidants for use in the layers of the photoreceptor include the following compounds but are not limited thereto.

(a) Phenolic compounds 2,6-di-t-butyl-p-cresol, butylated hydroxyanisole, 2,6-di-t-butyl-4-ethylphenol, n-octadecyl-3-(4'-hydroxy-3',5'-di-t-butylphenol), 2,2'-methylene-bis-(4-methyl-6-t-butylphenol), 2,2'-methylene-bis-(4-ethyl-6-t-butylphenol), 4,4'-thiobis-(3-methyl-6-t-butylphenol), 4,4'-butylidenebis-(3-methyl-6-t-butylphenol), 1,1,3-tris-(2-methyl-4-hydroxy-5-t-butylphenyl)butane, 1,3,5-trimethyl-2,4,6-tris(3,5-di-t-butyl-4-hydroxybenzyl)benzene, tetrakis-[methylene-3-(3',5'-di-t-butyl-4'-hydroxyphenyl) propionate]methane, bis[3,3'-bis(4'-hydroxy-3'-t-butylphenyl)butyric acid)glycol ester, tocophenol compounds, and the like.

(b) Paraphenylenediamine compounds

N-phenyl-N'-isopropyl-p-phenylenediamine, N,N'-di-sec-butyl-p-phenylenediamine, N-phenyl-N-sec-butyl-p-phenylenediamine, N,N'-di-isopropyl-p-phenylenediamine, N,N'-dimethyl-N,N'-di-t-butyl-p-phenylenediamine, and the like.

(c) Hydroquinone compounds 2,5-di-t-octylhydroquinone, 2,6-didodecylhydroquinone, 2-dodecylhydroquinone, 2-dodecyl-5-chlorohydroquinone, 2-t-octyl-5-methylhydroquinone, 2-(2-octadecenyl)-5-methylhydroquinone and the like.

(d) Organic sulfur-containing compounds
dilauryl-3,3'-thiodipropionate, distearyl-3,3'-thiodipropionate, ditetradecyl-3,3'-thiodipropionate, and the like.

(e) Organic phosphorus-containing compounds
triphenylphosphine, tri(nonylphenyl)phosphine, tri(dinonylphenyl)phosphine, tricresylphosphine, tri(2,4-dibutylphenoxy)phosphine and the like.

Suitable plasticizers for use in the layers of the photoreceptor include the following compounds but are not limited thereto:

(a) Phosphoric acid esters
triphenyl phosphate, tricresyl phosphate, trioctyl phosphate, octyldiphenyl phosphate, trichloroethyl phosphate, cresyldiphenyl phosphate, tributyl phosphate, tri-2-ethylhexyl phosphate, triphenyl phosphate, and the like.

(b) Phthalic acid esters
dimethyl phthalate, diethyl phthalate, diisobutyl phthalate, dibutyl phthalate, diheptyl phthalate, di-2-ethylhexyl phthalate, diisooctyl phthalate, di-n-octyl phthalate, dinonylphthalate, diisononylphthalate, diisodecyl phthalate, diundecyl phthalate, ditridecyl phthalate, dicyclohexyl phthalate, butylbenzyl phthalate, butyllauryl phthalate, methyloleyl phthalate, octyldecyl phthalate, dibutyl fumarate, dioctyl fumarate, and the like.

(c) Aromatic carboxylic acid esters
trioctyl trimellitate, tri-n-octyl trimellitate, octyl oxybenzoate, and the like.

(d) Dibasic fatty acid esters
dibutyl adipate, di-n-hexyl adipate, di-2-ethylhexyl adipate, di-n-octyl adipate, n-octyl-n-decyl adipate, diisodecyl adipate, dialkyl adipate, dicapryl adipate, di-2-etylhexyl azelate, dimethyl sebacate, diethyl sebacate, dibutyl sebacate, di-n-octyl sebacate, di-2-ethylhexyl sebacate, di-2-ethoxyethyl sebacate, dioctyl succinate, diisodecyl succinate, dioctyl tetrahydrophthalate, di-n-octyl tetrahydrophthalate, and the like.

(e) Fatty acid ester derivatives
butyl oleate, glycerin monooleate, methyl acetylricinolate, pentaerythritol esters, dipentaerythritol hexaesters, triacetin, tributyrin, and the like.

(f) Oxyacid esters
methyl acetylricinolate, butyl acetylricinolate, butylphthalylbutyl glycolate, tributyl acetylcitrate, and the like.

(g) Epoxy compounds
epoxydized soybean oil, epoxydized linseed oil, butyl epoxystearate, decyl epoxystearate, octyl epoxystearate, benzyl epoxystearate, dioctyl epoxyhexahydrophthalate, didecyl epoxyhexahydrophthalate, and the like.

(h) Dihydric alcohol esters
diethylene glycol dibenzoate, triethylene glycol di-2-ethylbutyrate, and the like.

(i) Chlorine-containing compounds
chlorinated paraffin, chlorinated diphenyl, methyl esters of chlorinated fatty acids, methyl esters of methoxychlorinated fatty acids, and the like.

(j) Polyester compounds
polypropylene adipate, polypropylene sebacate, acetylated polyesters, and the like.

(k) Sulfonic acid derivatives
p-toluene sulfonamide, o-toluene sulfonamide, p-toluene sulfoneethylamide, o-toluene sulfoneethylamide, toluene sulfone-N-ethylamide, p-toluene sulfone-N-cyclohexylamide, and the like.

(l) Citric acid derivatives
triethyl citrate, triethyl acetylcitrate, tributyl citrate, tributyl acetylcitrate, tri-2-ethylhexyl acetylcitrate, n-octyldecyl acetylcitrate, and the like.

(m) Other compounds
terphenyl, partially hydrated terphenyl, camphor, 2-nitro diphenyl, dinonyl naphthalene, methyl abietate, and the like.

Suitable lubricants for use in the layers of the photoreceptor include the following compounds but are not limited thereto.

(a) Hydrocarbons
liquid paraffins, paraffin waxes, micro waxes, low molecular weight polyethylenes, and the like.

(b) Fatty acids
lauric acid, myristic acid, palmitic acid, stearic acid, arachidic acid, behenic acid, and the like.

(c) Fatty acid amides
Stearic acid amide, palmitic acid amide, oleic acid amide, methylenebisstearamide, ethylenebisstearamide, and the like.

(d) Ester compounds
lower alcohol esters of fatty acids, polyhydric alcohol esters of fatty acids, polyglycol esters of fatty acids, and the like.

(e) Alcohols
cetyl alcohol, stearyl alcohol, ethylene glycol, polyethylene glycol, polyglycerol, and the like.

(f) Metallic soaps
lead stearate, cadmium stearate, barium stearate, calcium stearate, zinc stearate, magnesium stearate, and the like.

(g) Natural waxes
Carnauba wax, candelilla wax, beeswax, spermaceti, insect wax, montan wax, and the like.

(h) Other compounds
silicone compounds, fluorine compounds, and the like.

Suitable ultraviolet absorbing agents for use in the layers of the photoreceptor include the following compounds but are not limited thereto.

(a) Benzophenone compounds
2-hydroxybenzophenone, 2,4-dihydroxybenzophenone, 2,2',4-trihydroxybenzophenone, 2,2',4,4'-tetrahydroxybenzophenone, 2,2'-dihydroxy-4-methoxybenzophenone, and the like.

(b) Salicylate compounds
phenyl salicylate, 2,4-di-t-butylphenyl-3,5-di-t-butyl-4-hydroxybenzoate, and the like.

(c) Benzotriazole compounds
(2'-hydroxyphenyl)benzotriazole, (2'-hydroxy-5'-methylphenyl)benzotriazole, (2'-hydroxy-3'-t-butyl-5'-methylphenyl)-5-chlorobenzotriazole, and the like.

(d) Cyano acrylate compounds
ethyl-2-cyano-3,3-diphenyl acrylate, methyl-2-carbomethoxy-3-(paramethoxy) acrylate, and the like.

(e) Quenchers (metal complexes)

nickel(2,2'-thiobis(4-t-octyl)phenolate)-n-butylamine, nickeldibutyldithiocarbamate, cobaltdicyclohexyldithiophosphate, and the like.

(f) HALS (hindered amines)

bis(2,2,6,6-tetramethyl-4-piperidyl)sebacate, bis(1,2,2,6,6-pentamethyl-4-piperidyl)sebacate, 1-[2-{3-(3,5-di-t-butyl-4-hydroxyphenyl)propionyloxy}ethyl]-4-{3-(3,5-di-t-butyl-4-hydroxyphenyl)propionyloxy}-2,2,6,6-tetrametylpyridine, 8-benzyl-7,7,9,9-tetramethyl-3-octyl-1,3,8-triazaspiro[4,5]undecane-2,4-dione, 4-benzoyloxy-2,2,6,6-tetramethylpiperidine, and the like.

Hereinafter the image forming method and image forming apparatus of the present invention will be explained referring to drawings.

Figure 8:
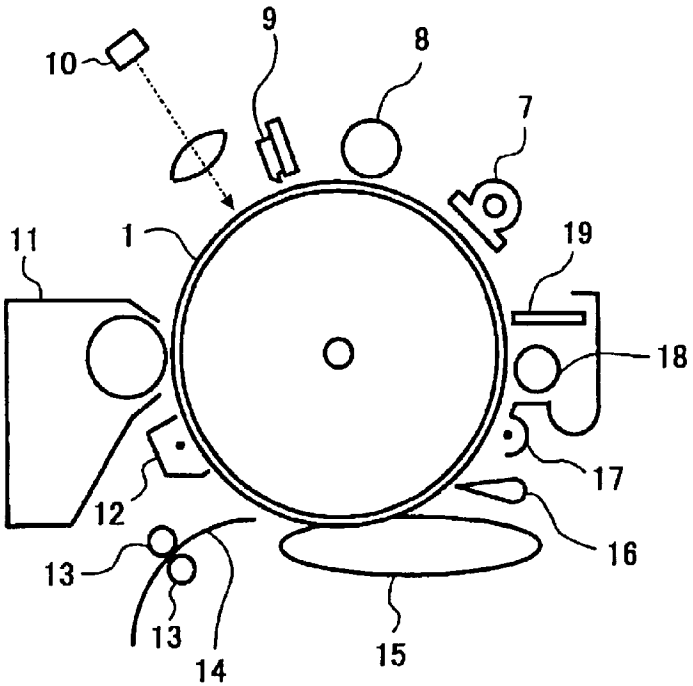
FIG. 8 is a schematic view illustrating an embodiment of the image forming apparatus of the present invention and for explaining the image forming method of the present invention.

FIG. 8 is a schematic view of an embodiment of the image forming apparatus of the present invention and for explaining the image forming method of the present invention.

In FIG. 8, numeral 1 denotes a photoreceptor. The photoreceptor 1 is the photoreceptor of the present invention. Although the photoreceptor 1 has a cylindrical shape in FIG. 8, but sheet photoreceptors, endless belt photoreceptors or the like can be used.

Around the photoreceptor 1, a discharging lamp 7 configured to discharge residual potential remaining on the surface of the photoreceptor 1, a charger 8 configured to charge the photoreceptor 1, an eraser 9 configured to erase an undesired portion of the charged area of the photoreceptor, an image irradiator 10 configured to irradiate the photoreceptor 1 with imagewise light to form an electrostatic latent image on the photoreceptor 1, an image developer 11 configured to develop the latent image with a toner to form a toner image on the photoreceptor 1, and a cleaning unit including a cleaning brush 18 and a cleaning blade 19 configured to clean the surface of the photoreceptor 1 are arranged while contacting or being set closely to the photoreceptor 1. The toner image formed on the photoreceptor 1 is transferred on a receiving paper 14 timely fed by a pair of registration rollers 13 at the transfer belt 15. The receiving paper 14 having the toner image thereon is separated from the photoreceptor 1 by a separating pick 16.

In the image forming apparatus of the present invention, a pre-transfer charger 12 and a pre-cleaning charger 17 may be arranged if desired.

As the charger 8, the pre-transfer charger 12, and the pre-cleaning charger 17, all known chargers such as corotrons, scorotrons, solid state chargers, and charging rollers can be used.

As the charger 8, contact chargers such as charging rollers, and proximity chargers in which, for example, a charging roller charges the photoreceptor while close to but not touching the image forming area of the surface of the photoreceptor, are typically used. When the photoreceptor is charged by the charger 8, a DC voltage overlapped with an AC voltage is preferably applied to the photoreceptor to avoid uneven charging.

As the transfer device, the above-mentioned chargers can be used. Among the chargers, a combination of the transfer charger and the separating charger is preferably used.

In FIG. 8, the toner image is directly transferred onto the receiving paper 14. However, an image forming method in which the toner image on the photoreceptor 1 is transferred onto an intermediate transfer medium and then transferred onto the paper can be used to improve the durability of the photoreceptor and produce high quality full color images.

Suitable light sources for use in the image irradiator 10 and the discharging lamp 7 include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wave length range, filters such as sharp-cut filters, band pass filters, near-infrared cutting filters, dichroic filters, interference filters, color temperature converting filters and the like can be used.

The above-mentioned lamps can be used for not only the processes mentioned above and illustrated in FIG. 8, but also other processes using light irradiation, such as a transfer process including light irradiation, a discharging process, a cleaning process including light irradiation and a pre-exposure process.

When the toner image formed on the photoreceptor 1 by the developing unit 6 is transferred onto the receiving paper 14, all of the toner image are not transferred on the receiving paper 14, and residual toner particles remain on the surface of the photoreceptor 1. The residual toner is removed from the photoreceptor 1 by the fur blush 18 and the cleaning blade 19. The residual toner remaining on the photoreceptor 1 can be removed by only the cleaning brush. Suitable cleaning blushes include known cleaning blushes such as fur blushes and mag-fur blushes.

When the photoreceptor 1 which is previously charged positively (or negatively) is exposed to imagewise light, an electrostatic latent image having a positive (or negative) charge is formed on the photoreceptor 1. When the latent image having a positive (or negative) charge is developed with a toner having a negative (or positive) charge, a positive toner image can be formed on the photoreceptor. In contrast, when the latent image having a positive (negative) charge is developed with a toner having a positive (negative) charge, a negative toner image (i.e., a reversal image) can be formed on the photoreceptor. As the developing method, known developing methods can be used. In addition, as the discharging methods, known discharging methods can also be used.

Figure 9:
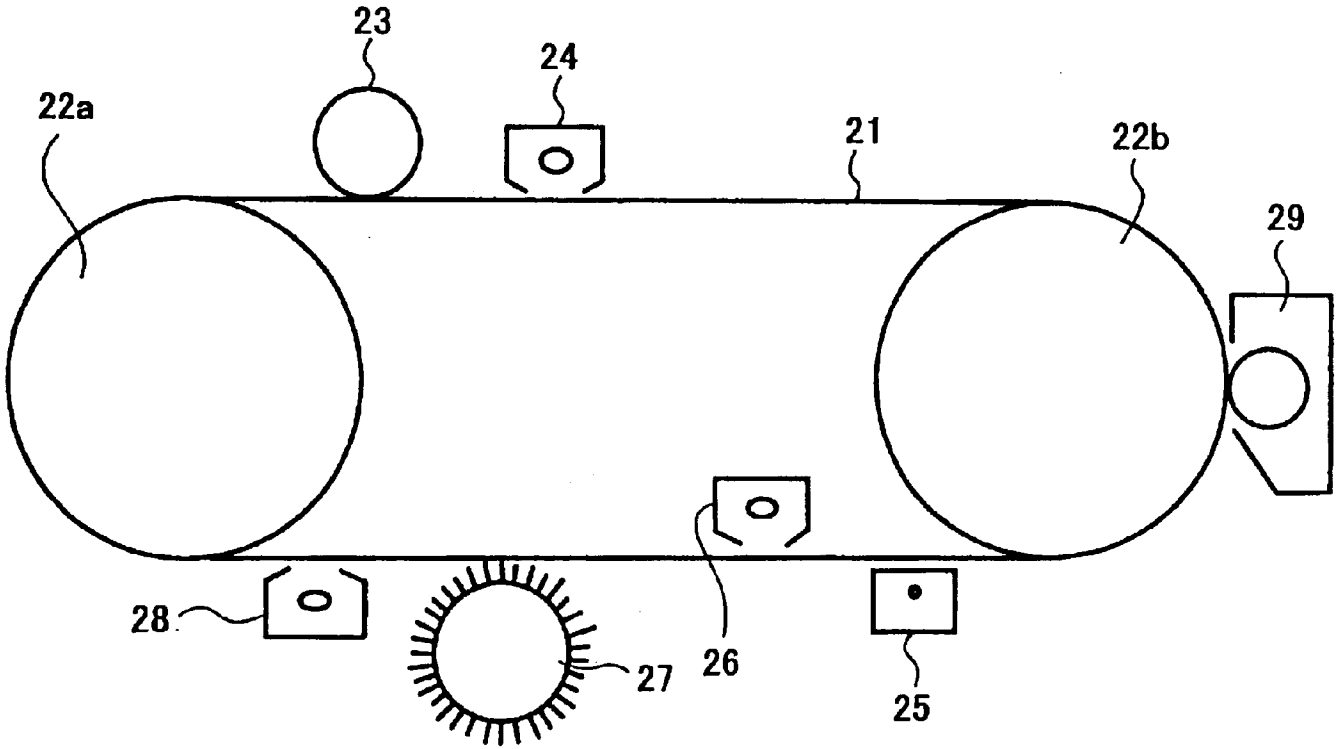
FIG. 9 is a schematic view illustrating another embodiment of the image forming apparatus of the present invention and for explaining the image forming method of the present invention.

FIG. 9 is a schematic view illustrating another embodiment of the image forming apparatus of the present invention. In this embodiment, a belt-shaped photoreceptor 21 is used. The photoreceptor 21 is the photoreceptor of the present invention.

The belt-shaped photoreceptor 21 is rotated by rollers 22*a* and 22*b*. The photoreceptor 21 is charged with a charger 23, and then exposed to imagewise light emitted by an imagewise light irradiator 24 to form an electrostatic latent image on the photoreceptor 21. The latent image is developed with a developing unit 29 to form a toner image on the photoreceptor 21. The toner image is transferred onto a receiving paper (not shown) using a transfer charger 25. After the toner image transferring process, the surface of the photoreceptor 21 is cleaned with a cleaning brush 27 after performing a pre-cleaning light irradiating operation using a pre-cleaning light irradiator 26. Then the charges remaining on the photoreceptor 21 are discharged by being exposed to light emitted by a discharging light source 28. In the pre-cleaning light irradiating process, light irradiates the photoreceptor 21 from the side of the substrate thereof. In this case, the substrate has to be light-transmissive.

The image forming apparatus of the present invention is not limited to the image forming units as shown in FIGS. 8 and 9. For example, in FIG. 9, the pre-cleaning light irradiating operation can be performed from the photosensitive layer side of the photoreceptor 21. In addition, the light irradiation in the light image irradiating process and the discharging process may be performed from the substrate side of the photoreceptor 21.

Further, a pre-transfer light irradiation operation, which is performed before transferring the toner image, a preliminary light irradiation operation, which is performed before the imagewise light irradiation operation, and other light irradiation operations may also be performed.

The above-mentioned image forming unit may be fixedly set in a copier, a facsimile or a printer. However, the image forming unit may be set therein as a process cartridge. The process cartridge means an image forming unit which includes at least a photoreceptor and a housing containing the photoreceptor. In addition, the process cartridge may include one of a charger, an image irradiator, an image developer, an image transferer, a cleaner and a discharger.

Figure 10:
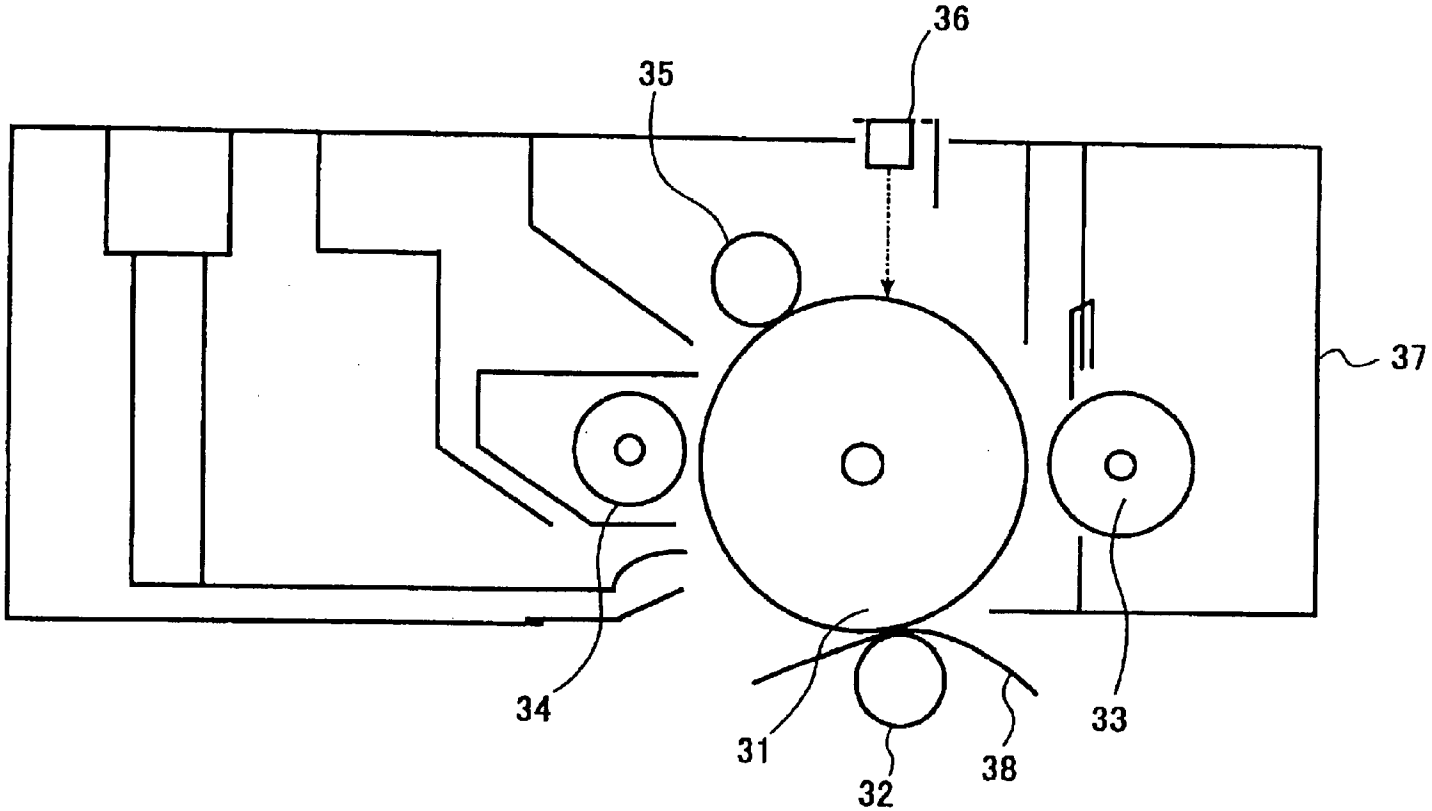
FIG. 10 is a schematic view illustrating an embodiment of the process cartridge of the present invention.

FIG. 10 is a schematic view illustrating an embodiment of the process cartridge of the present invention. In FIG. 10, the process cartridge includes a photoreceptor 31, a charger 35 configured to charge the photoreceptor 31, an image irradiator 36 configured to irradiate the photoreceptor 31 with imagewise light to form an electrostatic latent image on the photoreceptor 31, an image developer (a developing roller) 33 configured to develop the latent image with a toner to form a toner image on the photoreceptor 31, an image transferer 32 configured to transfer the toner image onto a receiving paper 38, a cleaning brush 34 configured to clean the surface of the photoreceptor 31, and a housing 37. The photoreceptor 31 is the photoreceptor of the present invention. The process cartridge of the present invention is not limited thereto.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Formation of Undercoat Layer

The following components were mixed to prepare an undercoat layer coating liquid.

| | |
|---|---|
| Alkyd resin (BEKKOZOL 1307-60-EL from Dainippon Ink & Chemicals, Inc.) | 3 |
| Melamine resin (SUPER BEKKAMIN G-821-60 from Dainippon Ink & Chemicals, Inc.) | 2 |
| Titanium oxide (CR-EL from Ishihara Sangyo Kaisha, Ltd.) | 20 |
| Methyl ethyl ketone | 100 |

The undercoat layer coating liquid was coated on an aluminum cylinder having an outside diameter of 30 mm by a dip coating method, and then dried. Thus, an undercoat layer having a thickness of 3.5 $\mu$m was formed.

Formation of CGL

The following components were mixed to prepare a CGL coating liquid.

| | |
|---|---|
| Bisazo pigment having the following formula | 5 |

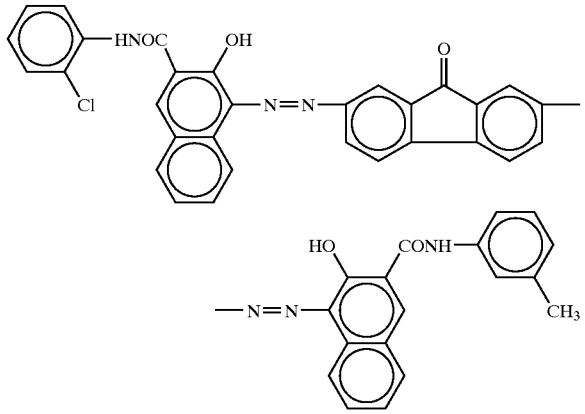

| | |
|---|---|
| Polyvinyl butyral (XYHL from Union Carbide Corp.) | 1 |
| 2-butanone | 100 |
| Tetrahydrofuran | 200 |

The CGL coating liquid was coated on the undercoat layer by a dip coating method and then heated to dry the coated liquid. Thus a CGL having a thickness of 0.2 $\mu$m was formed.

Formation of CTL

The following components were mixed to prepare a CTL coating liquid.

| | |
|---|---|
| Bisphenol Z-form polycarbonate | 1 |
| CTM having the following formula (a) | 1 |

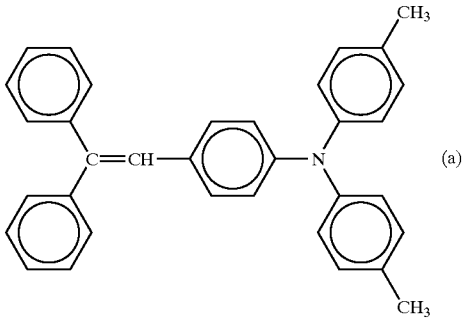

(a)

| | |
|---|---|
| Tetrahydrofuran | 10 |

The CTL coating liquid was coated on the CGL by a dip coating method, and then heated to dry the coated liquid. Thus, a CTL having a thickness of 22 $\mu$m was formed.

Formation of Protective Layer (i.e., Surface Layer)

The following components were mixed to prepare a protective layer coating liquid.

| | |
|---|---|
| Low molecular weight charge transport material having following (a) | 3 |

-continued

| | |
|---|---|
| Bisphenol Z-form polycarbonate resin | 4 |
| Silica (KMPX100 from Shin-Etsu Chemical Co., Ltd.) | 3 |
| Tetrahydrofuran | 170 |
| Cyclohexanone | 50 |

The protective layer coating liquid was coated on the CTL by a spray coating method, and then heated at 150° C. for 20 minutes to dry the coated liquid.

The conditions of the spray coating were as follows:

(1) Spray gun: MTSD A100-P08 manufactured by Meiji Machine Co., Ltd.)

(2) Discharge rate: 14 cc/min (3) Discharging pressure: 1.5 kg/cm$^2$ (4) Rotation number of photoreceptor: 360 rpm (5) Feeding speed of spray gun: 24 mm/sec (6) Distance between spray gun and photoreceptor: 8 cm (7) Number of times of spray coating operation: 4 times Thus, a protective layer was formed.

Thus, a photoreceptor of Example 1 was prepared.

Example 2

The procedure for preparation of the photoreceptor in Example 1 was repeated except that the spray coating operation was performed 7 times.

Thus, a photoreceptor of Example 2 was prepared.

Example 3

The procedure for preparation of the photoreceptor in Example 1 was repeated except that the discharge rate was changed to 12 cc/min, the spray gun feeding speed was changed to 16 mm/sec and the spray coating operation was performed 5 times.

Thus, a photoreceptor of Example 3 was prepared.

Example 4

The procedure for preparation of the photoreceptor in Example 1 was repeated except that the discharge rate was changed to 10 cc/min, the spray gun feeding speed was changed to 16 mm/sec and the spray coating operation was performed 6 times.

Thus, a photoreceptor of Example 4 was prepared.

Example 5

The procedure for preparation of the photoreceptor in Example 1 was repeated except that the discharge rate was changed to 6 cc/min, the spray gun feeding speed was changed to 16 mm/sec and the spray coating operation was performed 9 times.

Thus, a photoreceptor of Example 5 was prepared.

Example 6

The procedure for preparation of the photoreceptor in Example 1 was repeated except that the discharge rate was changed to 15 cc/min, the discharging pressure was changed to 2.0 kg/cm$^2$ and the surface layer coating liquid was replaced with the following.

Surface Layer Coating Liquid

| | |
|---|---|
| Low molecular weight CTM having formula (a) | 3 |
| Bisphenol Z-form polycarbonate | 4 |
| Alumina powder (AA03 from Sumitomo Chemical Co., Ltd.) | 3 |
| Tetrahydrofuran | 170 |
| Cyclohexanone | 50 |

Thus, a photoreceptor of Example 6 was prepared.

Example 7

The procedure for preparation of the photoreceptor in Example 6 was repeated except that the discharge rate was changed to 11.5 cc/min, the discharging pressure was changed to 2.0 kg/cm$^2$ and the spray coating operation was performed 6 times.

Thus, a photoreceptor of Example 7 was prepared.

Example 8

The procedure for preparation of the photoreceptor in Example 1 was repeated except that the discharge rate was changed to 15 cc/min, the discharging pressure was changed to 2.0 kg/cm$^2$ and the surface layer coating liquid was replaced with the following.

Surface Layer Coating Liquid

| | |
|---|---|
| Charge transport polymer having the following formula | 7 |

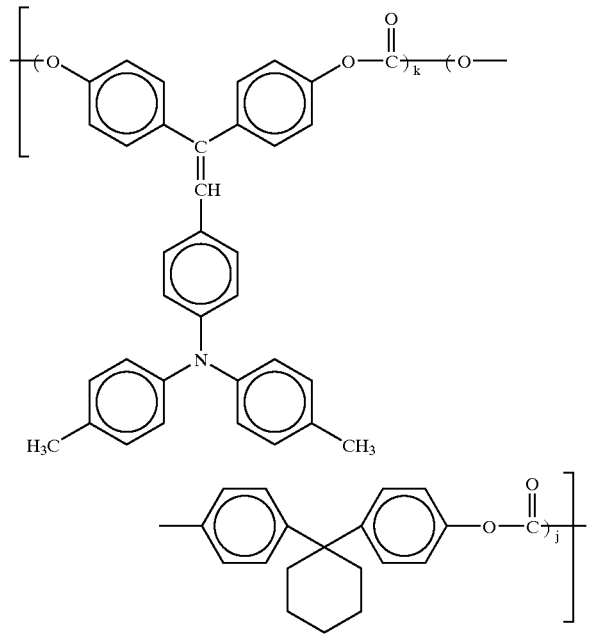

| | |
|---|---|
| Alumina powder (AA03 from Sumitomo Chemical Co., Ltd.) | 3 |
| Tetrahydrofuran | 170 |
| Cyclohexanone | 50 |

Thus, a photoreceptor of Example 8 was prepared.

Example 9

The procedure for preparation of the photoreceptor in Example 1 was repeated except that the discharge rate was changed to 15 cc/min, the discharging pressure was changed to 2.0 kg/cm$^2$ and the surface layer coating liquid was replaced with the following.

Surface Layer Coating Liquid

| | |
|---|---|
| Charge transport polymer having the following formula | 7 |

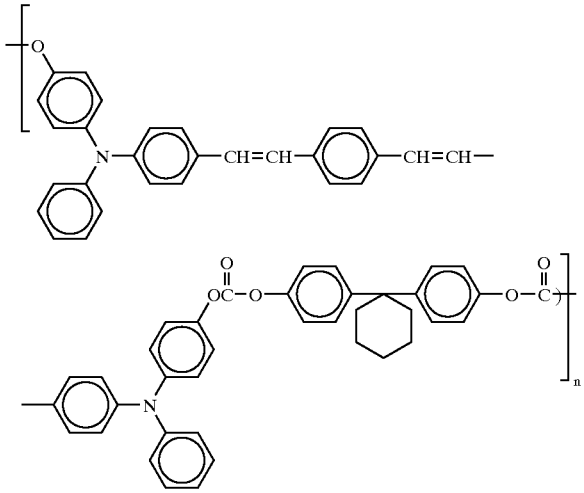

| | |
|---|---|
| Alumina powder (AA03 from Sumitomo Chemical Co., Ltd.) | 3 |
| Tetrahydrofuran | 170 |
| Cyclohexanone | 50 |

Thus, a photoreceptor of Example 9 was prepared.

Example 10

The procedure for preparation of the photoreceptor in Example 1 was repeated except that the discharge rate was changed to 15 cc/min, the discharging pressure was changed to 2.0 kg/cm$^2$, the spray coating operation was performed twice and the surface layer coating liquid was replaced with the following.

Surface Layer Coating Liquid

| | |
|---|---|
| Low molecular weight CTM following formula (a) | 3 |
| Polyarylate resin (U-6000 from Unitika Ltd.) | 4 |
| Titanium oxide powder (CR97 from Ishihara Sangyo Kaisha Ltd.) | 3 |
| Tetrahydrofuran | 170 |
| Cyclohexanone | 50 |

Thus, a photoreceptor of Example 10 was prepared.

Example 11

The procedure for preparation of the photoreceptor in Example 1 was repeated except that the surface layer coating liquid was replaced with the following.

Surface Layer Coating Liquid

| | |
|---|---|
| Low molecular weight charge transport material having following (a) | 3 |
| Bisphenol Z-form polycarbonate resin | 4 |
| Silica (KMPX100 from Shin-Etsu Chemical Co., Ltd.) | 3 |

-continued

| | |
|---|---|
| Dioxolan | 170 |
| Cyclohexanone | 50 |

Thus, a photoreceptor of Example 11 was prepared.

Example 12

The procedure for preparation of the photoreceptor in Example 1 was repeated except that the surface layer coating liquid was replaced with the following.

Surface Layer Coating Liquid

| | |
|---|---|
| Low molecular weight charge transport material having following (a) | 3 |
| Bisphenol Z-form polycarbonate resin | 4 |
| Silica (KMPX100 from Shin-Etsu Chemical Co., Ltd.) | 3 |
| Tetrahydrofuran | 170 |
| Cyclopentanone | 50 |

Thus, a photoreceptor of Example 12 was prepared.

Example 13

The procedure for preparation of the photoreceptor in Example 1 was repeated except that the surface layer coating liquid was replaced with the following.

Surface Layer Coating Liquid

| | |
|---|---|
| Low molecular weight charge transport material having following (a) | 3 |
| Bisphenol Z-form polycarbonate resin | 4 |
| Silica (KMPX100 from Shin-Etsu Chemical Co., Ltd.) | 3 |
| Tetrahydrofuran | 170 |
| Anisole | 50 |

Thus, a photoreceptor of Example 13 was prepared.

Comparative Example 1

The procedure for preparation of the photoreceptor in Example 1 was repeated except that the discharge rate was changed to 18 cc/min, the discharging pressure was changed to 2.0 kg/cm$^2$, the spray gun feeding speed was changed to 16 mm and the spray coating operation was performed twice.

Thus a photoreceptor of Comparative Example 1 was prepared.

Comparative Example 2

The procedure for preparation of the photoreceptor in Example 1 was repeated except that the discharge rate was changed to 24 cc/min, the spray gun feeding speed was changed to 12 mm and the spray coating operation was performed once.

Thus, a photoreceptor of Comparative Example 2 was prepared.

Comparative Example 3

The procedure for preparation of the photoreceptor in Example 1 was repeated except that the surface layer coating liquid was replaced with the following.

Surface Layer Coating Liquid

| | |
|---|---|
| Low molecular weight charge transport material having following (a) | 3 |
| Bisphenol Z-form polycarbonate resin | 4 |
| Silica (KMPX100 from Shin-Etsu Chemical Co., Ltd.) | 3 |
| Tetrahydrofuran | 50 |
| Cyclohexanone | 170 |

Thus, a photoreceptor of Comparative Example 3 was prepared.

Comparative Example 4

The procedure for preparation of the photoreceptor in Example 1 was repeated except that the CTL coating liquid and the surface layer coating liquid were replaced with the following, respectively.

CTL Coating Liquid

| | |
|---|---|
| Bisphenol A-form polycarbonate | 1 |
| Low molecular weight CTM having formula (a) | 1 |
| Dichloroethane | 12 |

Surface Layer Coating Liquid

| | |
|---|---|
| Low molecular weight charge transport material having following (a) | 3 |
| Bisphenol Z-form polycarbonate resin | 4 |
| Silica (KMPX100 from Shin-Etsu Chemical Co., Ltd.) | 3 |
| Toluene | 220 |

At this point, toluene cannot dissolve the bisphenol A-form polycarbonate in the CTL.

Thus, a photoreceptor of Comparative Example 4 was prepared.

Comparative Example 5

The procedure for preparation of the photoreceptor in Example 1 was repeated except that the discharging pressure was changed to 2.0 kg/cm$^2$, and the surface layer coating liquid was replaced with the following.

Surface Layer Coating Liquid

| | |
|---|---|
| Low molecular weight charge transport material having following (a) | 3 |
| Bisphenol Z-form polycarbonate resin | 4 |
| Alumina powder (AA03 from Sumitomo Chemical Co., Ltd.) | 3 |
| Tetrahydrofuran | 50 |
| Cyclohexanone | 170 |

Thus, a photoreceptor of Comparative Example 5 was prepared.

Comparative Example 6

The procedure for preparation of the photoreceptor in Example 1 was repeated except that the discharge rate was changed to 15 cc/min, the discharging pressure was changed to 2.0 kg/cm$^2$, the spray coating operation was performed twice and the surface layer coating liquid was replaced with the following.

Surface Layer Coating Liquid

| | |
|---|---|
| Low molecular weight charge transport material having following (a) | 3 |
| Polyarylate resin (U-6000 from Unitika Ltd.) | 4 |
| Titanium oxide powder (CR97 from Ishihara Sangyo Kaisha, Ltd.) | 3 |
| Tetrahydrofuran | 40 |
| Cyclohexanone | 180 |

Thus, a photoreceptor of Comparative Example 6 was prepared.

Comparative Example 7

The procedure for preparation of the photoreceptor in Example 1 was repeated except that the surface layer coating liquid was replaced with the following and the surface layer coating liquid was coated by a ring coating method.

Surface Layer Coating Liquid

| | |
|---|---|
| Low molecular weight charge transport material having following (a) | 3 |
| Bisphenol Z-form polycarbonate resin | 4 |
| Silica (KMPX100 from Shin-Etsu Chemical Co., Ltd.) | 3 |
| Tetrahydrofuran | 90 |

Conditions of Ring Coating

Coating speed: 3.0 mm/sec

Thus, a photoreceptor of Comparative Example 7 was prepared.

Comparative Example 8

The procedure for preparation of the photoreceptor in Example 1 was repeated except that the surface layer coating liquid was replaced with the following.

Surface Layer Coating Liquid

| | |
|---|---|
| Low molecular weight charge transport material having following (a) | 3 |
| Bisphenol Z-form polycarbonate resin | 4 |
| Silica (KMPX100 from Shin-Etsu Chemical Co., Ltd.) | 3 |
| Tetrahydrofuran | 220 |

Thus, a photoreceptor of Comparative Example 8 was prepared.

Comparative Example 9

The procedure for preparation of the photoreceptor in Example 1 was repeated except that the surface layer coating liquid was replaced with the following.

Surface Layer Coating Liquid

| | |
|---|---|
| Low molecular weight charge transport material having following (a) | 3 |
| Bisphenol Z-form polycarbonate resin | 4 |
| Silica (KMPX100 from Shin-Etsu Chemical Co., Ltd.) | 3 |
| Cyclohexanone | 220 |

Thus, a photoreceptor of Comparative Example 9 was prepared.

Comparative Example 10

The procedure for preparation of the photoreceptor in Example 1 was repeated except that the surface layer was not formed and the thickness of the CTL was changed to 27 μm.

Thus, a photoreceptor of Comparative Example 10 was prepared.

Evaluation 1

(1) Measurements of Average Maximum Thickness D of Surface Layer and Standard Deviation σ of the Maximum Thickness A cross section of each of the photoreceptors of Examples 1 to 13 and Comparative Examples 1 to 10 was observed by a scanning electron microscope to determine the average maximum thickness D and standard deviation a of the maximum thickness.

(2) Ratio A/B

The procedures for preparation of the surface layers in Examples 1 to 13 and Comparative Examples 1 to 6 and 8 and 9 were repeated except that the surface layer was formed directly on the aluminum substrate to determine the ratio A/B thereof. The way to determine the ratio A/B is mentioned above.

(3) Running Test

Each of the photoreceptors of Examples 1 to 13 and Comparative Examples 1 to 7 and 10 was set in a copier, which is Imagio MF2200 manufactured by Ricoh Co., Ltd. and modified as mentioned below, to perform a running test in which 120,000 copies were produced.

a) light source of image irradiator: laser diode emitting light having a wavelength of 655 nm b) polygon mirror: used b) charging voltage: DC bias of −900V (not overlapped with AC voltage)

At the beginning and end of the running test, the potential (Vl) of the lighted-area of each of the photoreceptors, image qualities, quantity of abrasion of each surface layer and adhesion of the surface layer were measured and evaluated.

With respect to image qualities, half-tone images, dot images and solid images were evaluated by classifying as follows:

1) Half-Tone Images

Each of the produced half-tone images was visually observed by naked eyes and an optical microscope. The quality of the half-tone image was classified as follows.

◎: excellent

○: good but slightly uneven locally

Δ: entire the half tone image is slightly uneven

X: uneven-density half tone image

2) Dot Images

A dot toner image consisting of plural one-dot images produced using a light beam having average beam diameter of 50 μm and formed on each photoreceptor was observed by an optical microscope to evaluate the dot reproducibility and toner scattering of the dot toner images. The quality of the dot toner image was classified as follows.

◎: excellent

○: good but the dot toner image is slightly fat locally

Δ: the dot toner image is fat

X: the dot toner image is fat and toner is scattered around the dot image

3) Black Solid Images

A black solid image of 5 cm in length and 3 cm in width was formed and visually observed by naked eyes and an optical microscope. The quality of the solid image was classified as follows.

○: good

X: the edge portion is slightly fat and toner is scattered around the edge portion The results are shown in Tables 1, 2 and 3.

TABLE 1

| | D (μm) | σ (μm) | A/B | Note |
|---|---|---|---|---|
| Ex. 1 | 5.02 | 0.78 | 1.54 | D/7 < σ ≦ D/5 |
| Ex. 2 | 8.32 | 1.25 | 1.84 | D/7 < σ ≦ D/5 |
| Ex. 3 | 4.98 | 0.82 | 1.47 | D/7 < σ ≦ D/5 |
| Ex. 4 | 5.12 | 0.62 | 1.43 | σ ≦ D/7 |
| Ex. 5 | 4.89 | 0.45 | 1.31 | σ ≦ D/7 |
| Ex. 6 | 5.06 | 0.81 | 1.78 | D/7 < σ ≦ D/5 |
| Ex. 7 | 4.97 | 0.63 | 1.67 | σ ≦ D/7 |
| Ex. 8 | 5.14 | 0.85 | 1.92 | D/7 < σ ≦ D/5 |
| Ex. 9 | 5.07 | 0.79 | 1.85 | D/7 < σ ≦ D/5 |
| Ex. 10 | 3.42 | 0.55 | 1.42 | D/7 < σ ≦ D/5 |
| Ex. 11 | 4.85 | 0.75 | 1.67 | D/7 < σ ≦ D/5 |
| Ex. 12 | 5.12 | 0.81 | 1.62 | D/7 < σ ≦ D/5 |
| Ex. 13 | 4.76 | 0.71 | 1.42 | D/7 < σ ≦ D/5 |
| Comp. Ex. 1 | 5.07 | 1.11 | 2.08 | D/5 < σ |
| Comp. Ex. 2 | 5.02 | 1.21 | 2.38 | D/5 < σ |
| Comp. Ex. 3 | 4.99 | 1.14 | 2.13 | D/5 < σ |
| Comp. Ex. 4 | 5.01 | 0.00 | 1.53 | Discontinuous structure, uneven thickness |
| Comp. Ex. 5 | 5.02 | 1.12 | 2.17 | D/5 < σ |
| Comp. Ex. 6 | 3.51 | 0.78 | 2.24 | D/5 < σ |
| Comp. Ex. 7 | 5.03 | 1.15 | — | Coated by a ring coating method |
| Comp. Ex. 8 | 5.25 | 0.52 | 1.15 | Formation of undesired structures |
| Comp. Ex. 9 | 4.67 | 1.20 | 2.52 | Surface layer has a spirally uneven thickness |
| Comp. Ex. 10 | — | — | — | No surface layer |

TABLE 2

| | At the beginning of the running test | | | | At the end of the running test | | |
|---|---|---|---|---|---|---|---|
| | | Image qualities | | | | Image qualities | |
| | V1 (V) | Half-tone image | Dot image | Solid image | V1 (V) | Half-tone image | Dot image |
| Ex. 1 | −80 | ○ | ◎ | ○ | −55 | ○ | ○ |
| Ex. 2 | −90 | ○ | ○ | ○ | −80 | ○ | ○ |
| Ex. 3 | −55 | ○ | ◎ | ○ | −50 | ○ | ○ |
| Ex. 4 | −50 | ◎ | ◎ | ○ | −40 | ○ | ◎ |

TABLE 2-continued

| | At the beginning of the running test | | | | At the end of the running test | | |
|---|---|---|---|---|---|---|---|
| | | Image qualities | | | | Image qualities | |
| | V1 (V) | Half-tone image | Dot image | Solid image | V1 (V) | Half-tone image | Dot image |
| Ex. 5 | −50 | ◎ | ◎ | ○ | −40 | ◎ | ◎ |
| Ex. 6 | −90 | ◎ | ○ | ○ | −80 | ○ | ○ |
| Ex. 7 | −80 | ◎ | ◎ | ○ | −70 | ○ | ◎ |
| Ex. 8 | −95 | ◎ | ○ | ○ | −95 | ○ | ○ |
| Ex. 9 | −100 | ○ | ○ | ○ | −95 | ○ | ○ |
| Ex. 10 | −85 | ○ | ○ | ○ | −75 | ○ | ○ |
| Ex. 11 | −85 | ○ | ◎ | ○ | −50 | ○ | ○ |
| Ex. 12 | −80 | ○ | ◎ | ○ | −55 | ○ | ○ |
| Ex. 13 | −85 | ○ | ◎ | ○ | −50 | ○ | ○ |
| Comp. Ex. 1 | −65 | Δ | ○ | ○ | −70 | X | Δ |
| Comp. Ex. 2 | −75 | Δ | ○ | ○ | −80 | X | Δ |
| Comp. Ex. 3 | −70 | ○ | Δ | ○ | −85 | X | X |
| Comp. Ex. 4 | −150 | ◎ | ◎ | X | — | — | — |
| Comp. Ex. 5 | −95 | ○ | Δ | ○ | −90 | Δ | X |
| Comp. Ex. 6 | −100 | Δ | Δ | ○ | −105 | X | X |
| Comp. Ex. 7 | −60 | Δ | Δ | ○ | −70 | X | X |
| Comp. Ex. 10 | −45 | ◎ | ◎ | X | −35 | X | X |

TABLE 3

| | 30000th image | | 60000th image | | 90000th image | | 120000th image | |
|---|---|---|---|---|---|---|---|---|
| | AB* | AB speed** | AB* | AB speed** | AB* | AB speed** | AB* | AB speed** |
| Ex. 1 | 0.92 | 0.31 | 1.95 | 0.34 | 2.91 | 0.32 | 3.85 | 0.31 |
| Ex. 2 | 0.97 | 0.32 | 2.04 | 0.36 | 2.99 | 0.32 | 3.91 | 0.31 |
| Ex. 3 | 0.98 | 0.33 | 2.01 | 0.34 | 3.02 | 0.34 | 4.01 | 0.33 |
| Ex. 4 | 1.01 | 0.34 | 2.05 | 0.35 | 3.05 | 0.33 | 4.09 | 0.35 |
| Ex. 5 | 1.10 | 0.37 | 2.21 | 0.37 | 3.25 | 0.35 | 4.31 | 0.35 |
| Ex. 6 | 0.65 | 0.22 | 1.31 | 0.22 | 2.01 | 0.23 | 2.72 | 0.24 |
| Ex. 7 | 0.71 | 0.24 | 1.45 | 0.25 | 2.21 | 0.25 | 3.01 | 0.27 |
| Ex. 8 | 0.54 | 0.18 | 1.14 | 0.20 | 1.68 | 0.18 | 2.24 | 0.19 |
| Ex. 9 | 0.49 | 0.16 | 1.01 | 0.17 | 1.54 | 0.18 | 2.08 | 0.18 |
| Ex. 10 | 0.85 | 0.28 | 1.67 | 0.27 | 2.42 | 0.25 | 3.25 | 0.28 |
| Ex. 11 | 0.89 | 0.30 | 1.80 | 0.30 | 2.72 | 0.31 | 3.65 | 0.31 |
| Ex. 12 | 0.95 | 0.32 | 1.85 | 0.30 | 2.81 | 0.32 | 3.84 | 0.34 |
| Ex. 13 | 1.00 | 0.33 | 1.97 | 0.32 | 2.90 | 0.31 | 3.91 | 0.34 |
| Comp. Ex. 1 | 0.93 | 0.31 | 1.80 | 0.29 | 2.72 | 0.31 | 4.20 | 0.49 |
| Comp. Ex. 2 | 0.97 | 0.32 | 1.95 | 0.33 | 3.21 | 0.42 | 4.81 | 0.53 |
| Comp. Ex. 3 | 0.94 | 0.31 | 1.85 | 0.30 | 2.76 | 0.30 | 4.15 | 0.46 |
| Comp. Ex. 4 | 0.92 | 0.31 | Not produced due to surface layer peeling | | | | | |
| Comp. Ex. 5 | 0.67 | 0.22 | 1.41 | 0.25 | 2.02 | 0.20 | 3.21 | 0.40 |
| Comp. Ex. 6 | 0.84 | 0.28 | 1.72 | 0.29 | 2.61 | 0.30 | 4.21 | 0.53 |
| Comp. Ex. 7 | 0.92 | 0.31 | 2.20 | 0.43 | 3.35 | 0.38 | 4.75 | 0.47 |
| Comp. Ex. 10 | 3.21 | 1.07 | 6.45 | 1.08 | 9.84 | 1.13 | 13.54 | 1.23 |

AB*: Abrasion of surface of the photoreceptor (μm)
AB**: Abrasion speed (μm/10000 copies)

Each abrasion speed is calculated based on the 30000 copies of from first to $30000^{th}$, $30001^{st}$ to $60000^{th}$, $60001^{st}$ to $90000^{th}$ or $90001^{st}$ to $120000^{th}$ copy, respectively.

As can be understood from Table 3, the abrasion speed of the photoreceptors having a standard deviation σ greater than D/5 (i.e., the photoreceptors of Comparative Examples 1–3 and 5–6) is uneven.

Example 14

The procedures for preparation and evaluation of the photoreceptor of Example 1 were repeated except that an insulating tape having a thickness of 50 μm and a width of 5 mm was wound around both edge portions of the charging roller in the copier to form a gap (50 μm) between the charging roller and the photoreceptor.

As a result of the running test, the contamination of the charging roller, which was observed when the tape was not wound, was not observed, and therefore the first and the $120000^{th}$ image were good. However, the $120000^{th}$ image had a slightly uneven half tone image.

Example 15

The procedures for preparation and evaluation of the photoreceptor in Example 14 were repeated except that the charging conditions of the charging roller were changed as follow:

DC bias:
−900V

Ac bias:
2.0 kV (peak to peak voltage)
2 kHz (frequency)

As a result of the running test, the contamination of the charging roller, which was observed when the tape was not wound, was not observed, and the slightly uneven half-tone image, which was observed in Example 14, were not observed.

As can be understood from the above description, a photoreceptor having a good mechanical durability, and good electrophotographic properties and capable of producing images having good image qualities can be provided by properly forming a surface layer on a photosensitive layer according to the present invention. In addition, an image forming apparatus and process cartridge by which images having good image qualities can be stably produced for a long period of time without frequently changing the photoreceptor are provided.

This document claims priority and contains subject matter related to Japanese Patent Applications Nos. 2000-336588, 2001-072992 and 2001-302660, filed on Nov. 2, 2000, Mar. 14, 2001 and Sep. 28, 2001, respectively, incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A coating liquid, comprising a filler, a binder resin and a first organic solvent having a boiling point of from 50 to 80° C. and a second organic solvent having a boiling point of from 130 to 160° C.

2. The coating liquid according to claim 1, wherein the first organic solvent comprises an organic solvent selected from the group consisting of tetrahydrofuran and dioxolan.

3. The coating liquid according to claim 1, wherein the second organic solvent comprises an organic solvent selected from the group consisting of cyclohexanone, cyclopentanone and anisole.

4. The coating liquid according to claim 1, having a solid content of from 3.0 to 6.0% by weight.

5. The coating liquid according to claim 1, wherein the first organic solvent comprises tetrahydrofuran.

6. The coating liquid according to claim 1, wherein the first organic solvent comprises dioxolan.

7. The coating liquid according to claim 1, wherein the second organic solvent comprises cyclohexanone.

8. The coating liquid according to claim 1, wherein the second organic solvent comprises cyclopentanone.

9. The coating liquid according to claim 1, wherein the second organic solvent comprises anisole.

* * * * *